US007699015B1

(12) United States Patent
Said

(10) Patent No.: US 7,699,015 B1
(45) Date of Patent: Apr. 20, 2010

(54) SUB-ORDINATE VEHICLE RECOVERY/LAUNCH SYSTEM

(75) Inventor: Brian R Said, Jupiter, FL (US)

(73) Assignee: Lockheed Martin Corp., Bethesda, MD (US)

( * ) Notice: Subject to any disclaimer, the term of this patent is extended or adjusted under 35 U.S.C. 154(b) by 0 days.

(21) Appl. No.: 11/685,886

(22) Filed: Mar. 14, 2007

Related U.S. Application Data

(60) Provisional application No. 60/782,274, filed on Mar. 15, 2006.

(51) Int. Cl.

| | |
|---|---|
| ***B63B 21/56*** | (2006.01) |
| ***B63B 21/58*** | (2006.01) |
| ***B63B 23/00*** | (2006.01) |
| ***B63B 23/30*** | (2006.01) |
| ***B63C 9/00*** | (2006.01) |

(52) U.S. Cl. ..... 114/253; 114/249; 114/258; 114/259

(58) Field of Classification Search ..... 114/50, 114/51, 244, 249, 253, 254, 258–260, 365, 114/366, 375

See application file for complete search history.

(56) References Cited

U.S. PATENT DOCUMENTS

| | | | | |
|---|---|---|---|---|
| 2,896,564 | A * | 7/1959 | Wright | 114/262 |
| 3,147,732 | A * | 9/1964 | Nishioka | 114/254 |
| 3,943,875 | A | 3/1976 | Sanders | |
| 4,304,189 | A | 12/1981 | Wright | |
| 4,487,153 | A | 12/1984 | McMahon et al. | |
| 5,234,285 | A | 8/1993 | Cameron | |
| 5,253,605 | A | 10/1993 | Collins | |
| 5,378,851 | A | 1/1995 | Brooke et al. | |
| 5,447,115 | A | 9/1995 | Moody | |
| 5,995,882 | A | 11/1999 | Patterson et al. | |
| 6,148,759 | A | 11/2000 | Taylor | |
| 6,289,837 | B1 | 9/2001 | Stetzel | |
| 6,390,012 | B1 | 5/2002 | Watt et al. | |
| 6,612,251 | B1 | 9/2003 | Ness | |
| 6,883,453 | B1 * | 4/2005 | Mulhern | 114/253 |
| 7,156,036 | B2 * | 1/2007 | Seiple | 114/254 |
| 2006/0191457 | A1 * | 8/2006 | Murphy | 114/253 |

FOREIGN PATENT DOCUMENTS

| | | | |
|---|---|---|---|
| GB | 2024111 A | * | 1/1980 |
| GB | 2279045 A | * | 12/1994 |
| JP | 2001088779 A | * | 4/2001 |
| JP | 2004262255 A | * | 9/2004 |

* cited by examiner

*Primary Examiner*—Ajay Vasudeva
(74) *Attorney, Agent, or Firm*—Wallace G. Walter

(57) ABSTRACT

Sub-ordinate and host maritime vessels are connected to each other by a tow loop trailed by the host vessel through a capture frame which engages the sub-ordinate vessel. The capture frame acts to engage the sub-ordinate vessel in the transitional coordinate space shared jointly between the sub-ordinate and host vessels, which vessels can be either or both surface-going, submersible, and/or non-surface vessels. The capture frame possess features which allow it to disengage from the host vessel while remaining semi-related and recoverable by a linkage of one or more tensioned lines to the host vessel during the time that its tow loop is connected to the sub-ordinate vessel.

34 Claims, 22 Drawing Sheets

SUB-ORDINATE VEHICLE RECOVERY/LAUNCH SYSTEM

CROSS-REFERENCE TO RELATED APPLICATION

This application claims the benefit of commonly owned U.S. Provisional Patent Application 60/782,274 filed Mar. 15, 2006 by the applicant herein.

BACKGROUND OF THE INVENTION

The present invention relates to apparatus and method for the launching and recovery of a sub-ordinate vehicle by a host vehicle and, more particularly, to the launching and recovery of unmanned vehicles or craft by host vehicles.

Various systems are known by which a host vehicle can recover another vehicle. For example and in the case of two spacecraft in a zero-g or near zero-g environment, both spacecraft are equipped with sensors for determining their respective alignments along the roll, pitch, and yaw axes and their respective velocities and accelerations along or about those axes. The two spacecraft are aligned along a common axis using computer-controlled thrusters and/or other attitude-control devices with one or both of the spacecraft advanced along that axis toward one another until the two spacecraft physically contact or engage. The two-spacecraft model is relatively simple, since the zero-g or near zero-g environment does not subject the spacecraft to difficult-to-predict and/or difficult-to-compensate-for external forces.

The situation is different in the area of aircraft and sea-going vehicles, including both surface and sub-surface vehicles, where the presence of surface and sub-surface currents, turbulence, wave action, wind effects, and the like complicate the problem of sub-ordinate vehicle recovery and launching. In an ideal situation, the sub-ordinate vehicle approaches and aligns itself with the docking interface of the host vehicle and, during that period when alignment is optimum or at least acceptable, pilots itself or is piloted into inter-active engagement. The presence of surface and/or sub-surface currents, turbulence, waves, and wind acting on the two vehicles oftentimes makes a sustained docking alignment difficult if not impossible to achieve.

Issues related to docking include addressing the mis-alignment along the roll, pitch, and yaw axes, and the changes thereof, consequent to the independent movement of the host vehicle and the sub-ordinate vehicle in three-dimensional space while the two vehicles approach and 'close' the distance therebetween.

SUMMARY OF THE INVENTION

The present invention provides a system and method by which sub-ordinate vehicles can be launched by a host vehicle and be re-acquired or recovered by the host vehicle under conditions of variable and continuously changing external forces and moments. The recovery system is subject to minimal constraints during the initial part of the recovery process during that time when misalignments are largest. The recovery system is gradually constrained to incrementally decrease its compliance in a smooth and continuous manner as the recovery process proceeds, subjecting the to-be-recovered vehicle to proportionately and gradually increasing aligning forces and moments causing the misalignments to substantially and gradually decrease until such time that the to-be-recovered vehicle is subject to optimal or maximal constraints during the time that the recovery process is near complete and then comes to completion.

In a preferred form, the sub-ordinate and the host vehicles are maritime vessels connected to each other by a tow loop or loop-equivalent connection trailed by the host vessel through a capture frame or equivalent structure which engages the sub-ordinate vessel; in the alternative, the tow loop can engage the sub-ordinate vessel directly. The capture frame acts to engage the sub-ordinate vessel in the transitional coordinate space shared jointly between the sub-ordinate and host vessels, which vessels can be either or both surface-going, submersible, and/or non-surface (i.e., above the surface) vessels or crafts. The capture frame possess features which allow it to disengage from the host vessel while remaining semi-related and recoverable by a linkage of one or more tendons to the host vessel during the time prior to and after its tow loop is connected to the sub-ordinate vessel.

When the host vessel is underway, drag forces on the sub-ordinate vessel will cause the sub-ordinate vessel to re-align its heading to substantially conform to that of the host vessel causing loop-connection adjustment relative to the host vessel until such time that the loop connection is substantially, if not maximally, tensioned. During this time period, the loop is 'shortened' to draw the now-aligned sub-ordinate vessel toward or closer to the capture structure. As the loop is shortened, the sub-ordinate vessel is subject to increasing constraints, thereby reducing its ability to deviate from an acceptable alignment with its capture structure until such time that the sub-ordinate vessel docks or physically engages its capture structure. In a similar sequence, the capture structure then sequentially and gradually re-acquires features of the host vessel under the tension of its retaining tendon(s), incrementally aligning to and with the host vessel as the constraints thereon increase between it and the host vessel with increasing constraint (i.e., the shortening length) of the tendon(s).

The launching of the sub-ordinate vessel is the opposite of the recovery in which the connection tendon(s) and loop is progressively lengthened until such time that the sub-ordinate vessel can be released therefrom.

In the preferred form, the vessels can take the form of surface vessels, watercraft, or amphibious aircraft, sub-surface vessels, vessels having both surface and sub-surface and/or above-the-surface capabilities.

DESCRIPTION OF PREFERRED EMBODIMENTS

Figure 1B:
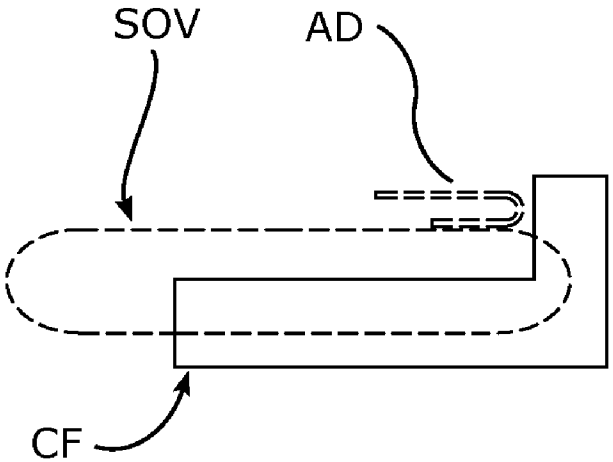
FIG. 1*b* is a side elevational view of the sub-ordinate vessel of FIG. 1*a* in a capture frame.
Figure 1A:
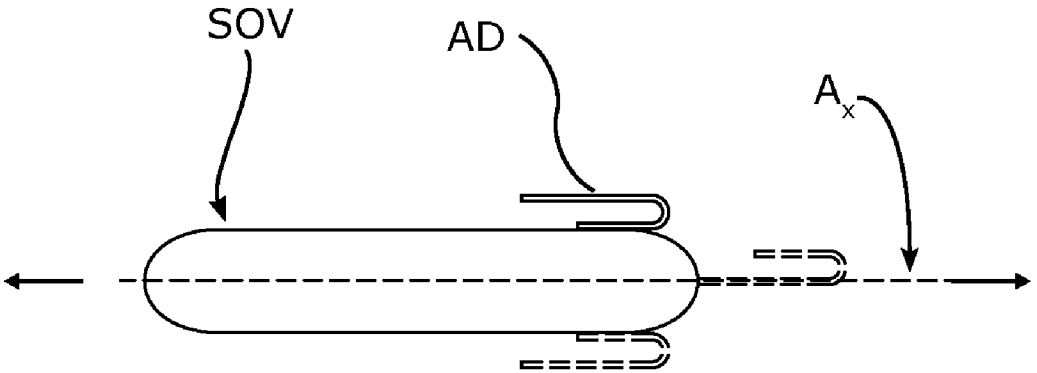
FIG. 1*a* is a side elevational view of an exemplary sub-ordinate vessel.

As shown in FIG. 1*a*, a sub-ordinate vessel SOV can take the generalized form of a cylindrical body formed about a longitudinal axes $A_x$ having ellipsoidal ends. An attachment device AD, shown in generalized form, is secured to the sub-ordinate vessel SOV for the purposes of selectively connecting the sub-ordinate vessel SOV to a towing loop or disconnecting the sub-ordinate vessel SOV from a towing loop as described below. While the attachment device AD is shown on the forward portion of the sub-ordinate vessel SOV, the attachment device AD can be in other locations, including, for example, the forwardmost portion on the longitudinal axis, or on the lowermost portion at some point intermediate the ends of the sub-ordinate vessel SOV, as represented in dotted-line illustration. While the attachment device AD shown in the figures takes the form of a simple hook, the attachment device AD can take a number of forms, including the classic hook (as shown), grapples, bitts, bollards, capstans, links, shackles, etc. as well as special-purpose designs. The attachment device AD preferably is of the type (i.e., mechanical, hydraulic, pneumatic, etc.) that can be selectively actuated or otherwise controlled to release any line with which it is engaged. The sub-ordinate vessel SOV can be a surface vessel, a sub-surface vessel having a controllable buoyancy sufficient to allow the vessel to maintain a selected depth below the surface, or a vessel capable of both surface and sub-surface operation. The sub-ordinate vessel SOV can include a propulsion system (i.e., one or more propellers, etc.), various fixed-position and/or controllable-position fins, vanes, and/or planes to control course or dive angles (in the case of a submersible sub-ordinate vessel SOV), as well as buoyancy control tanks or equivalent devices.

As shown in FIG. 1*b*, the a capture frame CF is designed to be mated with or interfaced with the sub-ordinate vessel SOV (shown in dotted-line). The capture frame CF, which is shown symbolically in FIG. 1*b*, can take the form of an open frame or closed frame structure having a portion thereof designed to receive or cradle the sub-ordinate vessel SOV. While not specifically shown, the capture frame CF can be provided with resilient pads, bumpers, snubbers, surface pads, and/or portions thereof specifically designed to engage or interengage with surfaces of or structures on the sub-ordinate vessel SOV. Also, various releaseable latches, clamps, and/or connectors can be provided to releaseably secure the sub-ordinate vessel SOV to the capture frame CF. As in the case of sub-ordinate vessel SOV, the capture frame CF can be provided with various fixed-position and/or controllable-position fins, vanes, and/or planes to control or stabilize its course, attitude and/or position within defined limits relative to the host vessel, as well as buoyancy control tanks or equivalent devices.

Figure 2:
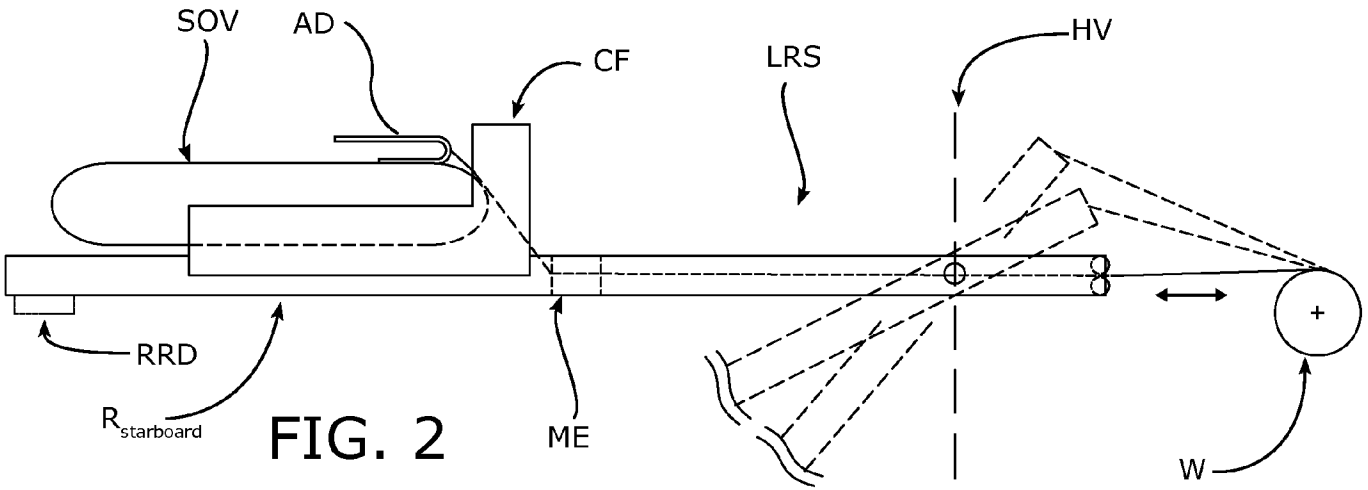
FIG. 2 is a side elevational view of the sub-ordinate vessel and capture frame of FIG. 1*b* in engagement with its launch/recovery structure.
Figure 3:
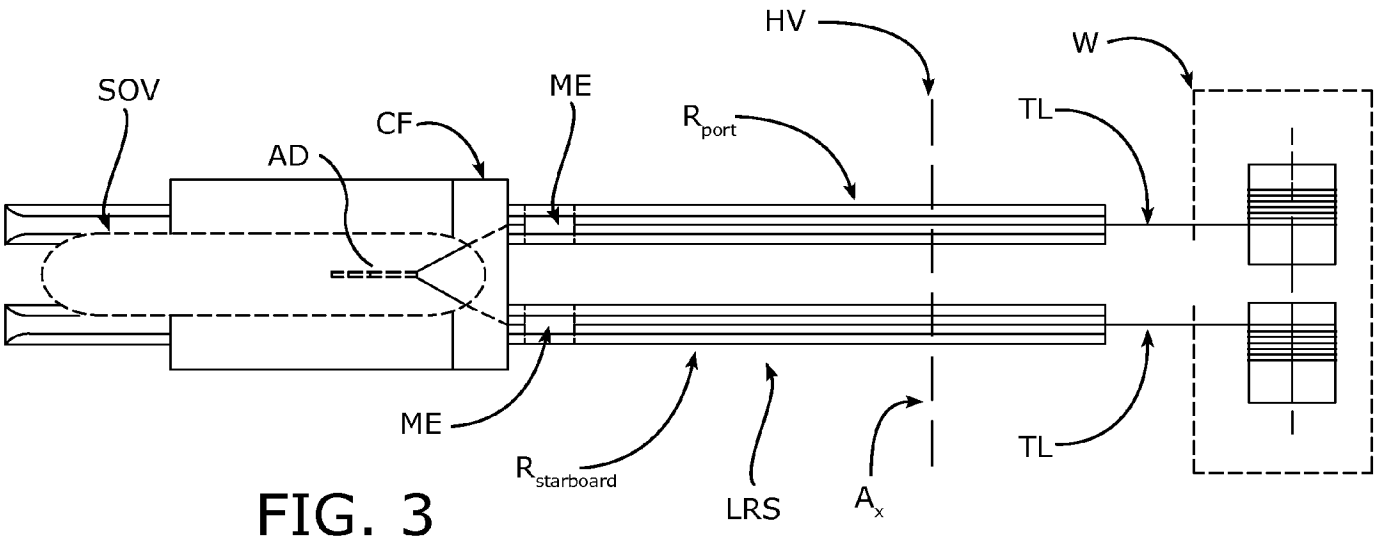
FIG. 3 is a top or plan view of the structure of FIG. 2.

FIGS. 2 and 3 illustrates the sub-ordinate vessel SOV interfaced with its capture frame CF in relationship to a symbolically represented launch/recovery structure LRS in which the launch/recovery structure LRS is shown in a generally horizontal alignment and in which the sub-ordinate vessel SOV and its capture frame CF are shown in their fully engaged configuration. As shown on the right in FIGS. 2 and 3, the launch/recovery structure LRS is journalled for bidirectional motion about a laterally aligned axis and may, optionally, be mounted for linear translation. Both the rotation and translation functions can be locked at one or more positions by the use of brake or clamp mechanisms (not shown). In a typical application, the launch/recovery structure LRS is carried on or connected to the stern portion of a surface host vessel HV or the stern portion of a sub-surface host vessel HV via direct connection or via an intermediate structure. In the figures, the launch/recovery structure LRS is defined by two spaced apart rails, $R_{port}$ and $R_{starboard}$. The two rail system shown in the figures and described below is merely exemplary, systems that use one rail only or more than two rails are equally suitable. In FIGS. 2 and 3, the dashed line HV symbolically represents the stern portion of the host vessel. A tow loop TL is shown in FIGS. 2 and 3 extending from the attachment device AD on the sub-ordinate vessel SOV through a portion of the capture frame CF and through or along the rails $R_{port}$ and $R_{starboard}$ of the launch/recovery structure LRS to a winch assembly W located on or within the host vessel HV. The rails $R_{port}$ and $R_{starboard}$ constitute a guideway or trackway for the capture frame CF. The tow loop TL is retracted to be taut or near optimally taut to pull the sub-ordinate vessel SOV into engagement with its capture frame CF and to pull the interengaged sub-ordinate vessel SOV and capture frame CF into engagement with the launch/recovery structure LRS and to align the launch/recovery structure LRS toward a horizontal or near horizontal alignment. Lowering the tension or tautness of the tow loop TL will allow the sub-ordinate vessel SOV and the capture frame CF to disengage from its engaged position on the launch/recovery structure LRS and also allow the unlocked launch/recovery structure LRS to rotate about and translate from the lateral axis $A_x$ (as shown in dotted-line in FIG. 2) on the host vessel HV. Thus, lowering or decreasing tension or tautness of the tow loop TL will cause the sub-ordinate vessel SOV and its capture frame CF to disengage with the launch/recovery structure LRS allowing the capture frame CF to initially space itself from or separate from the launch/recovery structure LRS and then allow the sub-ordinate vessel SOV to space itself from or separate from its capture frame CF.

In FIGS. 2 and 3, the winches W are shown as mounted on the stern of the host vessel HV; as can be appreciated, the winches W (or functionally equivalent line take-up and payout devices) can be located elsewhere on the host vessel HV or, if desired, on some portion of the launch/recovery structure LRS. As explained in more detail below in relationship to FIG. 10*a*, an additional winch can be optionally connected between the host vessel HV and the capture frame CF to facilitate independent control of the aft extent of the capture frame CF during launch and/or recovery operations.

Figure 4:
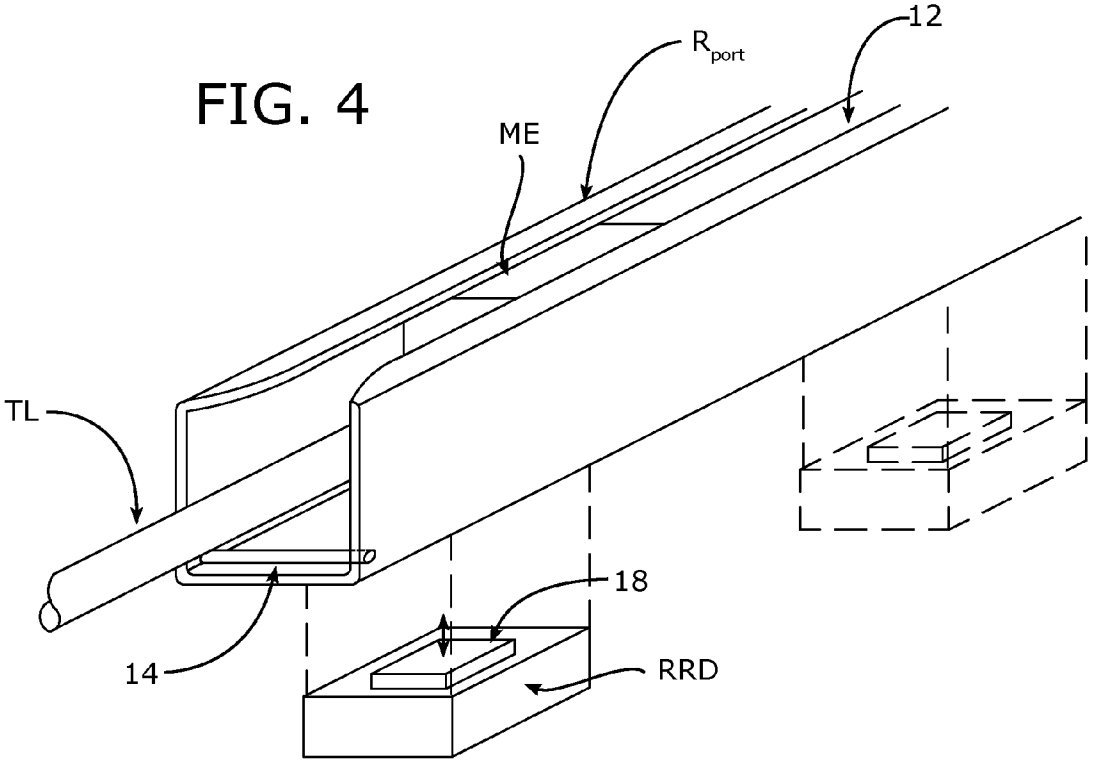
FIG. 4 is a perspective view of a portion of an exemplary rail structure.
Figure 6:
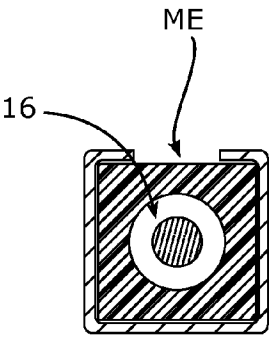
FIG. 6 is a cross-sectional view of a movable element taken along line 6-6 of FIG. 5.
Figure 5:
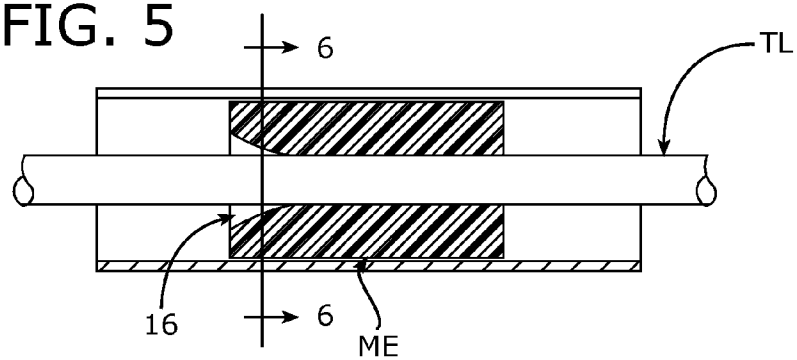
FIG. 5 is a cross-sectional view of a movable element contained within the rail structure of FIG. 4.

FIGS. 4-6 illustrates detail features of the rail configuration of the launch/recovery structure LRS shown in FIGS. 2 and 3; the illustrated rail configuration is representative only of other possible configurations. As shown in FIG. 4 (which illustrates the aft end of a rail R), the rail R is formed with a open-topped slot 12 into which a movable element ME is fitted. In the case of the embodiment shown, the moveable element ME is a square prism that fits within the interior channel defined by the rail R with sufficient clearance that the moveable element ME can freely slide lengthwise in and along the rail R. An end stop 14, which is shown as an exemplary cross-bolt, prevents the moveable element ME from dis-engaging or slipping out of the end of the rail R. The moveable elements ME can be fabricated from metal or plastics, including high-density polypropylene.

As shown in FIGS. 5 and 6, the moveable element ME also includes a length-wise thru-bore (unnumbered) through which a portion of the tow line TL is passed. The dimensional relationship between the outside diameter of the tow line TL and the inside diameter of the thru-bore is such that the tow line TL can easily slip relative to the moveable element ME. If desired, a conically shaped or funicular opening 16 can be defined to minimize stress in the tow line TL as it is moved about during launch and recovery operations. Since the tow line TL is designed to pass through the slot 12, the width of the slot 12 is such to allow easy passage of the tow line TL therethrough; additionally and as shown in FIG. 4, the remote end of the slot 12 can be generously radiused to present interference with or chaffing of the tow line TL.

In FIG. 4 a releaseable retention device RRD is attached or connected at or near the distal or remote end of the rail R. The releaseable retention device RRD is designed to hold the moveable element ME in a position at the near the end of the rail R during certain times in the recovery operation. The releaseable retention device RRD can take various forms, including a friction pad 18 or snubber that extends through a opening (not shown) in the underside of the rail R and is selectively actuated by, for example, a spring-actuated lever or catch, an hydraulic, pneumatic, and/or electrical actuator, to press the moveable element against the opposite side of the rail structure to retain the moveable element in ME in place until released. The releaseable retention device RRD can also be activated by contact against the leading edge or the sub-ordinate vessel SOV or the capture frame CF during that time that the capture frame CF is in partial engagement with the rail(s) or snubber. During the time that the moveable element ME is being retained in place, the portion of the tow line TL running through the bore in the moveable element ME is free to slide. While the preferred position of the releaseable retention device RRD is at or near the distal end of each rail R, as shown in dotted-line illustration, some embodiments may place the releaseable retention device RRD in a position spaced form the end of the rail R. In addition to the friction pad device shown in FIG. 4, other type devices, including various types of clamps, locks, and latches are equally suitable.

Figure 7:
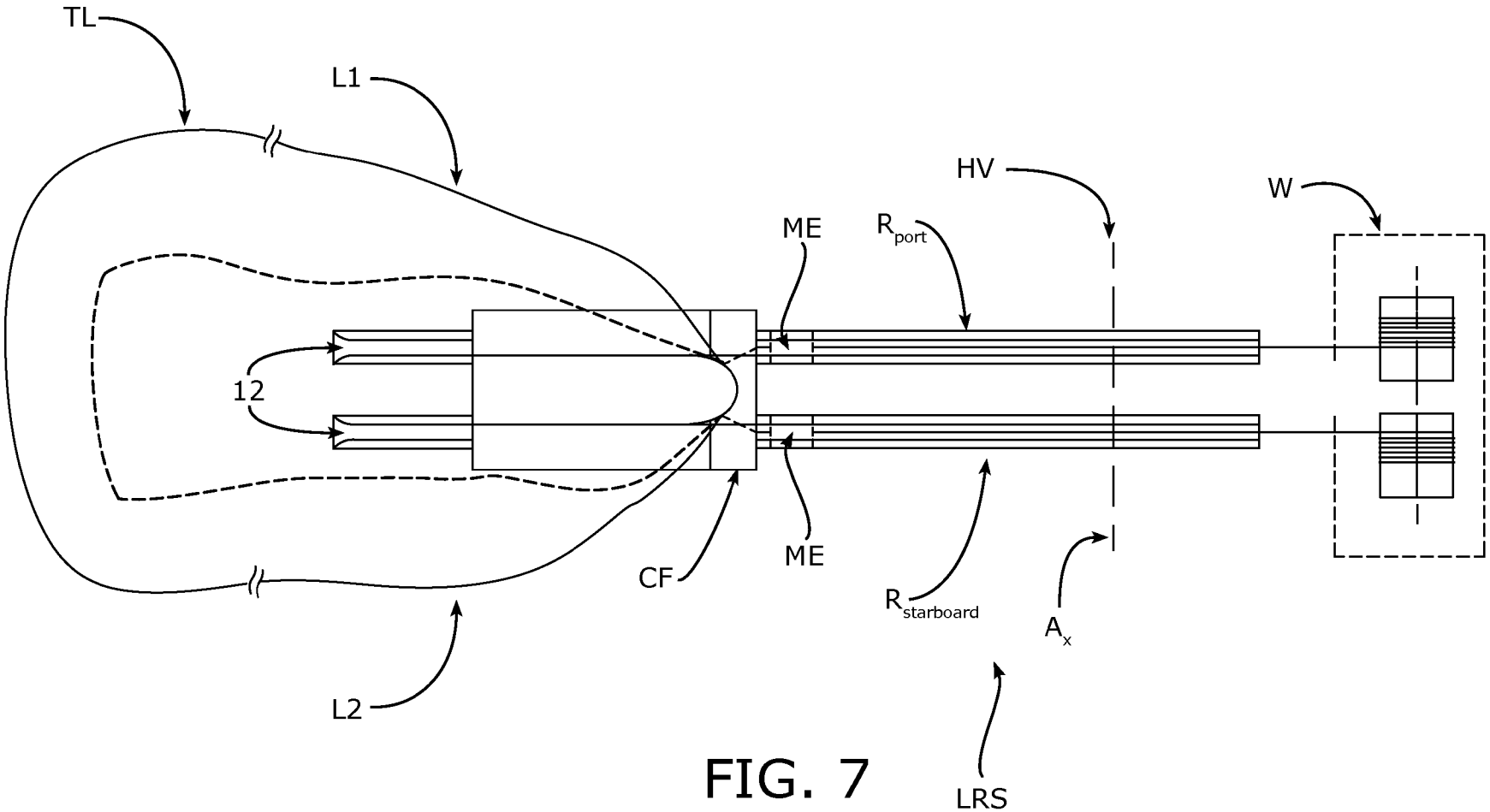
FIG. 7 is a top or plan view of the structure of FIGS. 2 and 3 with a tow loop in an extended position.

FIG. 7 illustrates the configuration of the tow loop TL and its relationship to the launch/recovery structure LRS. As shown, the launch/recovery structure LRS can take the form of two spaced rails $R_{port}$ and $R_{starboard}$ that can be independently journalled about the axis $A_x$ in FIG. 7 or, if desired, are joined together by cross-members (not shown) to form a unitized dual-rail structure. The tow loop TL is formed as a continuous length 'tendon' with a first leg portion L1 extending beyond the aft end of the rail $R_{port}$ and the other leg portion L2 extending beyond the aft end of the other rail $R_{starboard}$. The respective legs of the tow loop TL are threaded through passageways in the capture frame CF and through the moveable elements ME and along the length of the channel defined by each rail to the winch W in the stern of the host vessel HV. Since each rail $R_{port}$ and $R_{starboard}$ includes a lengthwise slot 12, a portion of the tendon that defines the tow loop TL can pass through its respective slot 12 to connect with the capture frame CF. While not specifically shown, various rollers, friction pads, and/or guides can be used to control the position of the tendon within each rail.

As represented by the solid-line and dotted-line representations of the tendon on the left in FIG. 7, the size of the tow loop TL can be varied by using the winch W to "take-up" one or both ends of the tendon. While the two ends of the tendon have been shown connected to the winding drum of individual winches W, other variants include connecting each end of the tow loop TL to the winding drum of a common winch, or, if desired, connecting only one end of the tendon to a winch and connecting the other end to a fixed attachment point on the host vessel HV. In the last configuration, the one winch is used to take-up the line that tensions and slacks the tendon. As represented in FIG. 7, the area embraced by the tow loop is easily varied and, if required, can be enlarged to many hundreds of square yards to ensure that any sub-ordinate vessel SOV within the area circumscribed 'target' area will recovered.

The relationship between the hook attachment device AD on the sub-ordinate vessel SOV to the tow loop TL and capture frame CF is such that the line that defines the tow loop can move, slide, or slip relative to the attachment device AD to allow the sub-ordinate vessel SOV to move along various portions of the tow loop TL as the system dynamically reconfigures during recovery (or launch) so as to center the sub-ordinate vessel SOV to the available tow line and share its loads between parts on both sides of the attachment device AD as described below. In general, standard nylon, polypropylene, manila, or other lines typically used in nautical applications can function as the line or tendon that defines the tow loop TL.

Figure 8:
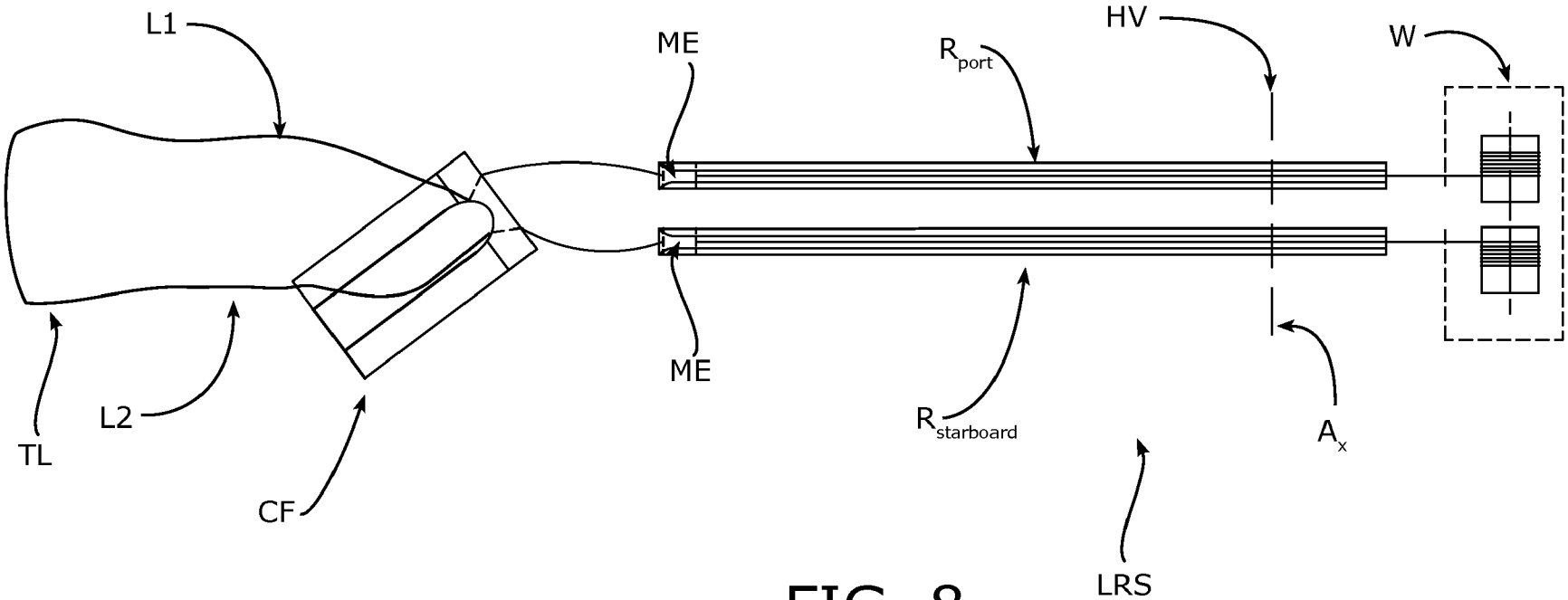
FIG. 8 is a top or plan view of the structure of FIG. 7 with a tow loop in an extended position and a capture frame engaged with the tow loop.

FIG. 8 represents one possible recovery configuration in which the tow loop TL has been extended and the capture frame CF disengaged from the launch/recovery structure LRS. In general, the capture frame CF has a buoyancy such that it will maintain a selected depth relative to the sub-ordinate vessel SOV that is considered optimal or near optimal for capturing the sub-ordinate vessel SOV; to this end, the capture frame CF can be provided with buoyancy control tanks and/or fixed or adjustable position fins, vanes, or planes to control its relative depth.

In FIG. 8, the capture frame CF is shown at some arbitrary mis-alignment with the launch/recovery structure LRS and the tow loop TL is shown with an undefined configuration. Since the rails $R_{port}$ and $R_{starboard}$ are pivotably mounted, they tend to rotate in such a way that their respective aft ends are lower than their forward ends (see FIG. 2). The moveable elements ME will slide or slip or be carried to the aft end of the each rail $R_{port}$ and $R_{starboard}$ by releaseable snap fits into the leading edge of the adjacent engaged capture frame CF where their respective releaseable retention device RRD is actuated to hold them in place. In this configuration, the tow line is constrained to exit the rails $R_{port}$ and $R_{starboard}$ at the aft ends thereof.

Figure 9:
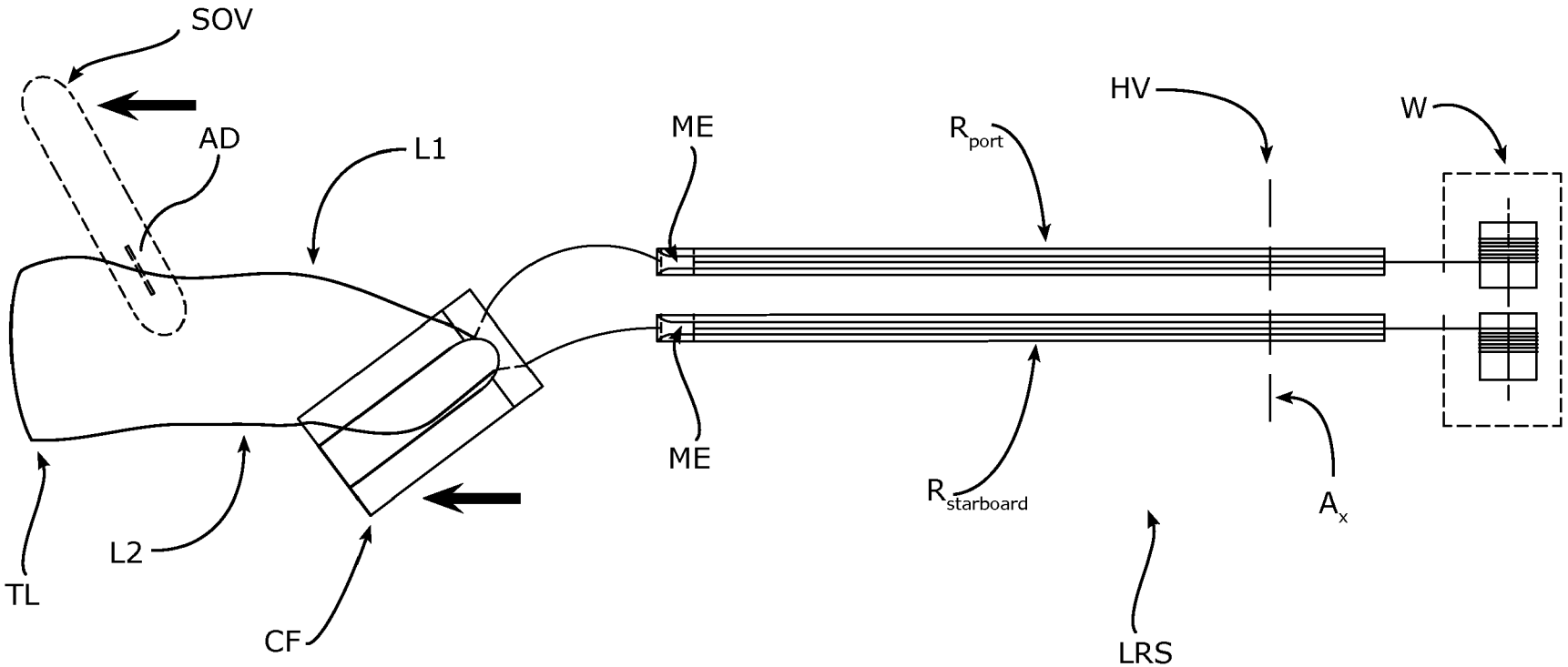
FIG. 9 is a top or plan view of the structure of FIG. 8 with a sub-ordinate vessel also connected to the extended tow loop.

As shown in FIG. 9, a sub-ordinate vessel SOV is 'hooked' by its attachment device AD onto some portion of the tow loop TL and has been shown at some arbitrary mis-alignment with both the capture frame CF and the launch/recovery structure LRS. In those cases where the sub-ordinate vessel SOV is an unpowered vessel (i.e., without propulsion), the extended tow loop TL can be pulled or dragged by the host vessel HV over the area surrounding sub-ordinate vessel SOV until some portion of the tow line TL "hooks" the attachment device AD. In those cases were the sub-ordinate vessel SOV is equipped with a propulsion system (e.g., a propeller) and is steerable, the sub-ordinate vessel SOV can be piloted into the area circumscribed by the tow loop TL and the sub-ordinate vessel SOV maneuvered to effect the 'hooking' operation.

Regardless of how the sub-ordinate vessel SOV is connected to the tow loop TL (i.e., by maneuver of the host vessel, maneuver of the sub-ordinate vessel SOV, or maneuver of both the host vessel and the sub-ordinate vessel SOV), forward motion of the host vessel HV at a selected speed, acceleration of the host vessel HV to a selected speed, or deceleration of the host vessel HV to a selected speed will cause fluid drag forces, as indicated by the arrows in FIG. 9, on the capture frame CF and the sub-ordinate vessel SOV to cause the tow loop TL to begin to elongate and both the capture frame CF and the sub-ordinate vessel SOV to "line-up" aft of the launch/recovery structure LRS. Those portions of the tow loop TL passing through the attachment device AD will slip or move relative the attachment device AD on the sub-ordinate vessel SOV with any friction forces between the tow loop TL and the attachment device AD on the sub-ordinate vessel SOV also causing the sub-ordinate vessel SOV to begin to re-align or re-point the sub-ordinate vessel SOV and the capture frame CF.

Figure 10:
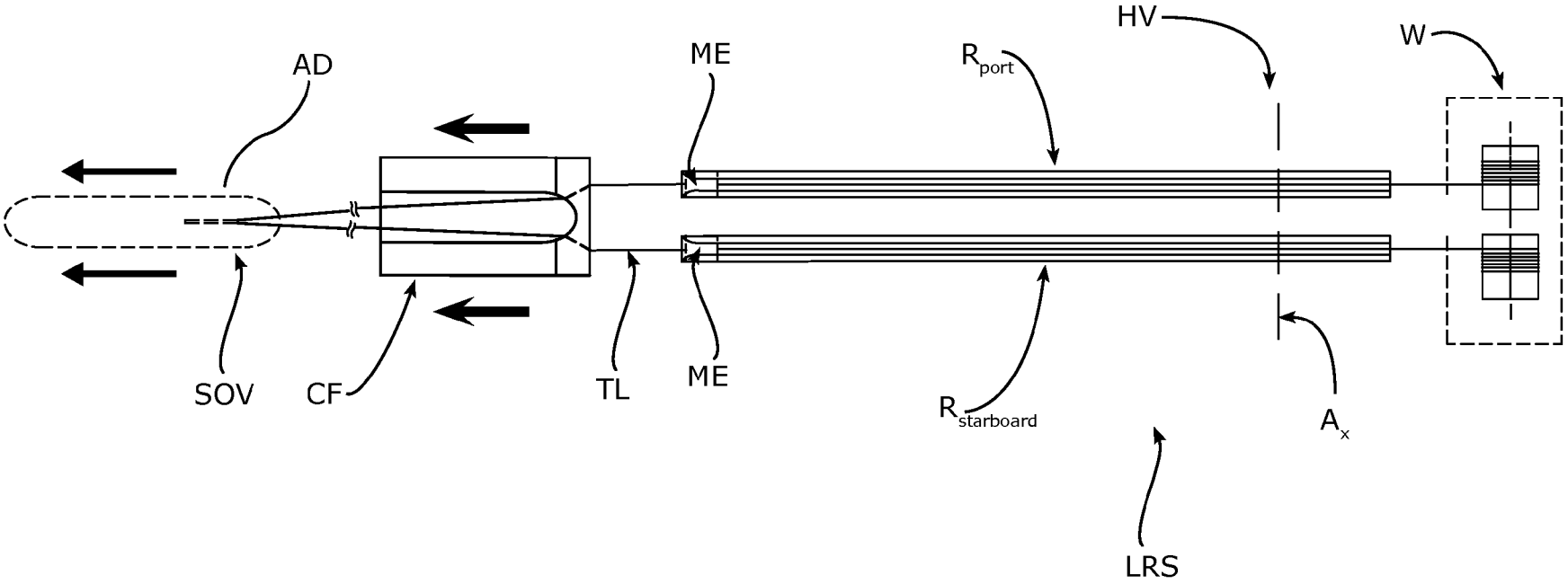
FIG. 10 illustrates the structure of FIG. 9 with the extended tow loop under tension with the arrows indicating drag forces on both the capture frame and the subordinate vessel.

At some point in this process and as shown in FIG. 10, the fluid drag forces on the sub-ordinate vessel SOV and the capture frame CF, depending upon the speed of the host vessel, become sufficiently high to fully tension the tow loop so that the tow loop is fully extended with the sub-ordinate vessel SOV and the capture frame CF in overall axial alignment with each other and the launch/recovery structure LRS. In general and depending upon the speed of the host vessel HV and the fluid drag forces, the sub-ordinate vessel SOV will self-align or substantially self-align with its capture frame CF and self-align or substantially self-align with the launch/recovery structure LRS. As explained below, this self-alignment or substantial self-alignment effectively "lines-up" the sub-ordinate vessel SOV for engagement with the capture frame CF and concurrently "lines-up" the capture frame CF and its sub-ordinate vessel SOV with the launch/recovery structure LRS.

When the sub-ordinate vessel SOV and its capture frame CF are "lined-up" as shown in FIG. 10, the tow loop TL is then "shortened" by operation of the winches W. As the tow loop TL is "shortened" and as shown in FIG. 10, the sub-ordinate vessel SOV will be pulled toward its capture frame CF; the capture frame CF will continue to trail aft of the launch/recovery structure LRS with the fluid drag forces maintaining the alignment of the capture frame CF. As the tow loop TL is shortened, those portions of the tow loop TL that are 'threaded through' the capture frame CF will slide or slip to allow relative motion between the capture frame CF and the tow loop TL such that the capture frame CF and the SOV 'close' on one another.

Figure 10A:
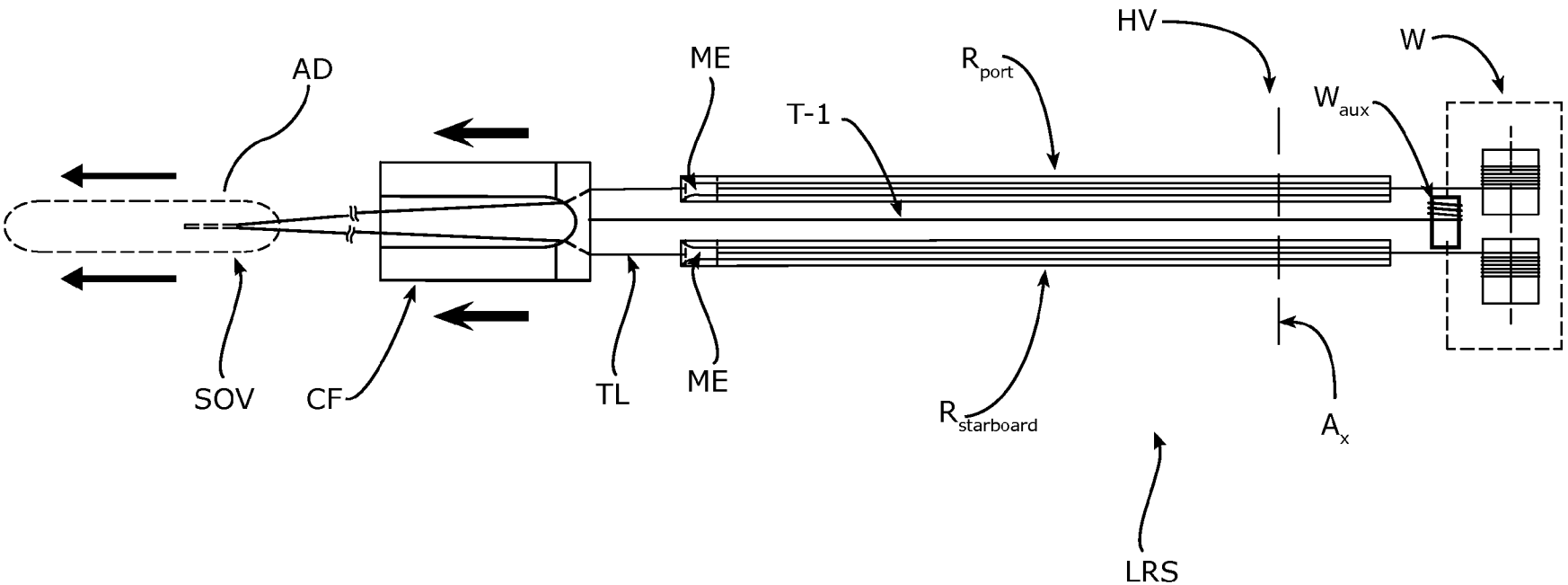
FIG. 10*a* illustrates an optional variant of the structure of FIG. 10*a* with the extended tow loop under tension and illustrating an auxiliary winch connected to the capture frame.

As shown in FIG. 10*a*, an optional tether line T-1 can be connected to the capture frame CF and to the launch recovery structure LRS to control the maximum extent that the capture frame CF can trail aft of the launch/recovery structure LRS. The capture frame tether can be a fixed-length "dead line" or can be an adjustable-length line by virtue of its attachment to an auxiliary winch $W_{aux}$.

At some point during the "shortening" of the tow loop TL, the sub-ordinate vessel SOV will mate with or engage the capture frame CF; clamps, latches, or similar devices (if any) can be actuated by the physical mating of the components or actuated by independent control to connect the parts.

Figure 11:
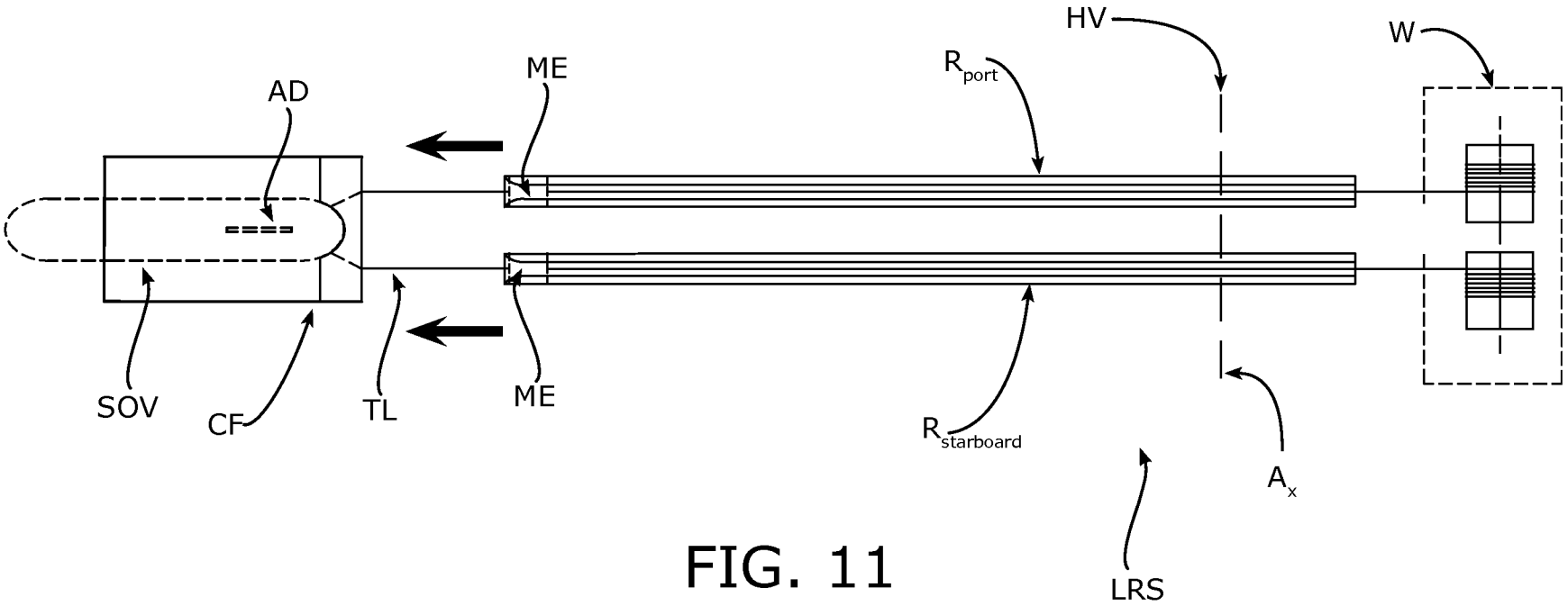
FIG. 11 illustrates the structure of FIG. 10 with the sub-ordinate vessel engaged with its capture frame with the arrows indicating drag forces on both the capture frame and the subordinate vessel.
Figure 12:
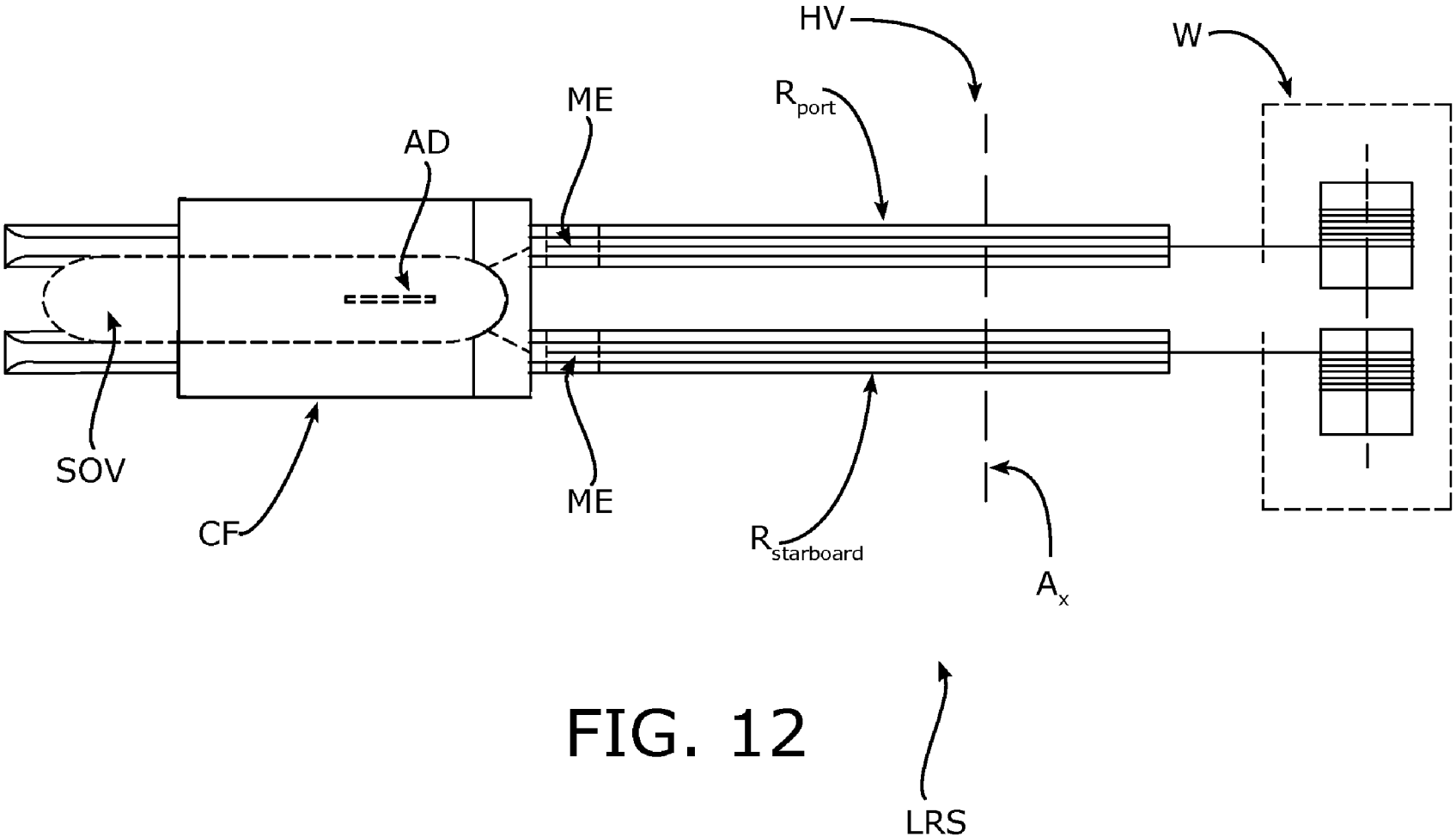
FIG. 12 illustrates the structure of FIG. 11 with the sub-ordinate vessel and its engaged capture frame engaging a launch/recovery structure.
Figure 13:
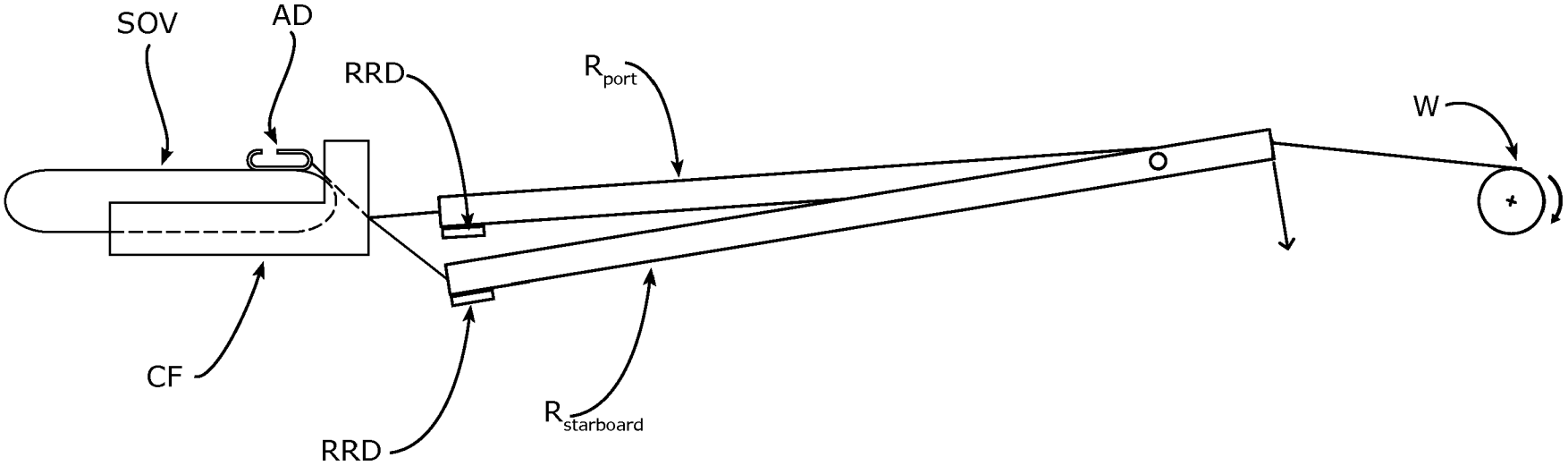
FIG. 13 is a side view of the sub-ordinate vessel with its capture frame slightly disengaged from the launch/recovery structure.

Once mating or interengagement or the sub-ordinate vessel SOV and the capture frame CF has been accomplished (as shown in FIG. 11), the tow loop TL can continue to be "shortened" to pull the mated capture frame/SOV toward the launch/recovery structure LRS. As shown in FIGS. 11 and 12, as the mated capture frame/SOV closely approaches the aft end of the launch/recovery structure LRS, a portion of the tension forces on the tow loop TL will resolve into torques tending to rotate the launch/recovery structure LRS toward the capture frame CF and the capture frame CF toward the launch/recovery structure LRS as shown in FIG. 13 (i.e., clockwise in FIG. 13). Thus, as the tow loop TL shortens, the constraints imposed on the launch/recovery structure LRS as it rotates toward the mated capture frame/SOV increases until such time that the mated capture frame/SOV contacts the aft end of the rails $R_{port}$ and $R_{starboard}$. At this point, the releaseable retention devices RRD are disengaged to allow the moveable elements ME to slide or move lengthwise in the channels defined by each rail $R_{port}$ and $R_{starboard}$. Since each rail is provided with a lengthwise slot 12 (FIG. 4), the tow line TL can freely extend from the moveable element ME through its respective slot 12 as the tow line TL is shortened. The moveable element ME within each rail rails $R_{port}$ and $R_{starboard}$ and the mated sub-ordinate vessel SOV and its capture frame CF on each rail moves towards the forward end of the respective rail with additional shortening of the tow line until the configuration of FIGS. 2 and 3 is attained. The rail system shown can be viewed as having female structure for interengagement with male keying elements affixed to the capture frame CF via the lengthwise slots; in the alternative, the rail structures can be provide with male structure for interengagement with female keying elements affixed to the capture frame CF via the lengthwise slots.

As can be appreciated, the rails $R_{port}$ and $R_{starboard}$ of the launch/recovery structure LRS can be provided with buoyancy tanks or similar devices or fixed and/or controllable fins, vanes, or planes to control the motion of the launch/recovery structure LRS so as to assist in the successful recovery of the mated capture frame/SOV.

In those embodiments in which an auxiliary winch $W_{aux}$ is used (FIG. 10*a*), the capture frame CF can be held at a selected distance aft of the host vessel during recovery. The auxiliary winch $W_{aux}$ can then be operated to lengthen its tether T-1 to cause the capture frame CF to move toward and slowly "close" on the sub-ordinate vessel SOV as its tether T-1 lengthens until such time that the sub-ordinate vessel SOV and the capture frame CF engage with one another. As a variant, the capture frame CF can be held a selected distance aft of the host vessel by the auxiliary winch $W_{aux}$ while the tow loop TL is shortened or "taken-up" by the winch W until such time that the sub-ordinate vessel SOV engages the capture frame CF. As a further variant, the tether T-1 can be lengthened to cause capture frame CF to move toward the trailing sub-ordinate vessel SOV while the tow loop TL is concurrently or simultaneously shortened or "taken-up" by the winch W to allow both the sub-ordinate vessel SOV and the capture frame CF to each "close" on the other.

Figure 14:
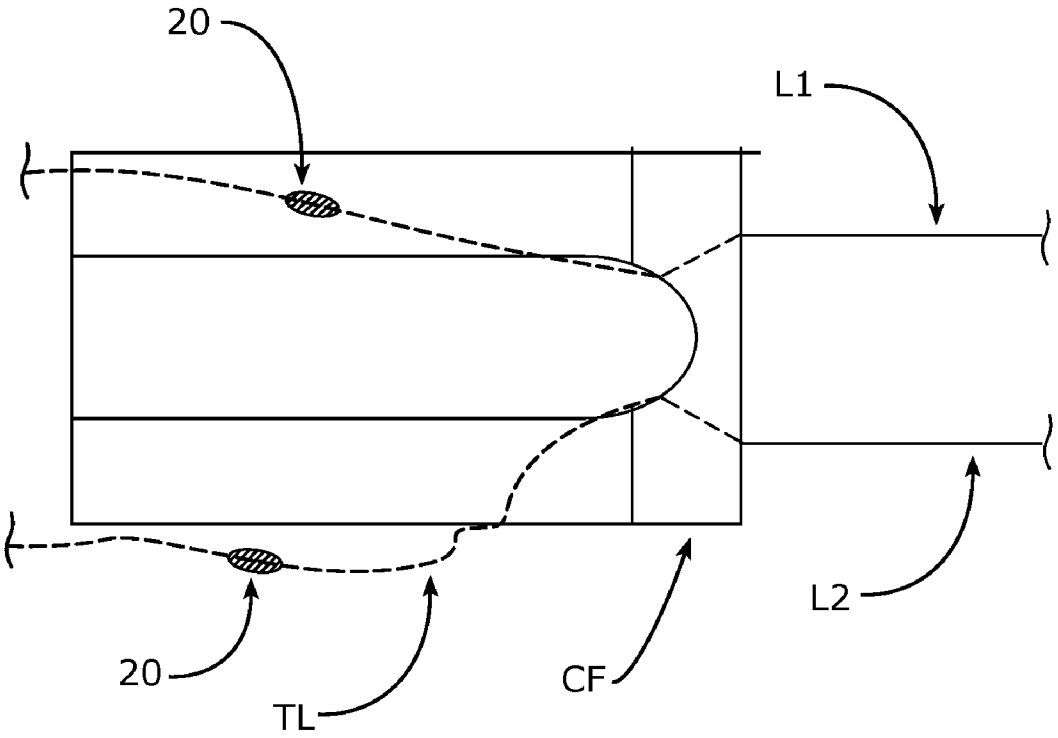
FIG. 14 illustrates cable stops on the tow loop.

As shown in FIG. 14, it is also possible to trail the capture frame CF at a selected distance aft of the launch/recovery structure LRS by placing controllable/releaseable cable brakes or clamps in or on the capture frame CF that cooperate with or act directly on the tow loop to controllably slow or selectively stop the motion of the capture frame CF relative to the tow loop and the SOV. The cable brake can take the form of a plate or friction shoe that presses against the tow loop or the form of opposing plates or friction shoes that press against the tow loop. The use of one or more cable brakes allows the velocity of the capture frame CF to be reduced or halted as the capture frame CF rides down the tow loop toward the SOV. The cable brakes can be selectively actuated via passive automatic triggering consequent to increasing cable tension or, alternatively, may be remotely triggered using remote-powered actuation and command/control.

Figure 15:
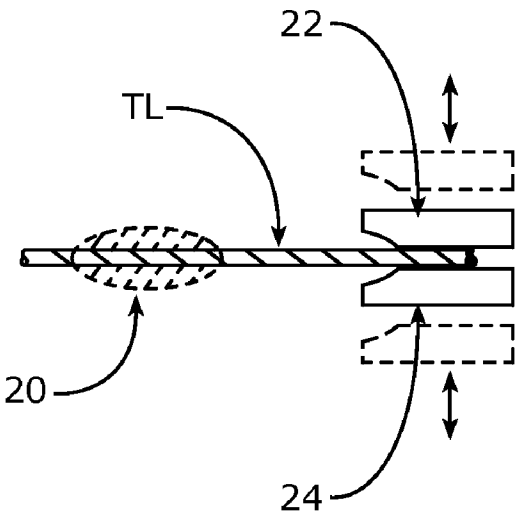
FIG. 15 is a detail of a cable stop and an associated releaseable cable stop or friction applying brake.

As a further variant, cable stops can be formed at selected position on the tow line; in FIG. 15, the cable stop 20 is typically formed as a two-piece ellipsoid that is secured to the tow line using threaded fasteners to hold the cable stop 20 in place. Additionally, selectively actuated releaseable cable brakes or clamps are installed in or on the capture frame CF. In FIG. 15, the cable brakes are schematically shown as opposed plates or shoes 22 and 24 that can be brought together against the tow line to receive the cable stop 20 and prevent movement of the tow line through the closed plates or shoes 22 and 24. As shown in dotted-line illustration, the cable shoes plates or shoes 22 and 24 can also be backed away or released from engagement with the tow line to allow the tow line and any cable stops thereon to pass freely. In addition to the cable stop 20 shown, a cylindrical ferrule or circular ring that is crimped to the tow line can also be used. In general, the cable stop 20 functions to increase the effective diameter of the tow line so that it will not pass between the closed plates or shoes 22 and 24. However, the increase the effective diameter of the tow line should also be small enough so that the cable stop will pass through the opening in the moveable element ME and the slot 12 formed in each rail and all fair leads, ports, holes, and reeving towards the proximal direction for launch/recovery.

In deploying the embodiment of FIG. 14 for sub-ordinate vessel SOV recovery and as shown, the capture frame CF and tow loop TL are extended as discussed in relationship to FIGS. 1-13 and the capture frame CF then deployed. As shown in FIG. 14, the cable stops 20, in cooperation with the cable brakes in the capture frame CF, will limit the maximum trailing extent of the capture frame CF with the tow line aft of the capture frame CF for connection to the sub-ordinate vessel SOV. When the sub-ordinate vessel SOV is attached to the tow loop and the tow loop is subsequently extended or made taut in response to the movement for the host vessel or made taut in response to the relative movement between the sub-ordinate vessel SOV and the host vessel, the cable brakes (i.e., plates 22 and 24 in FIG. 15) can be released to allow the capture frame CF to "ride down" the tow loop to the sub-ordinate vessel SOV at the trailing end of the tow loop and mate with or interengage with the sub-ordinate vessel SOV as described above. If desired, the cable brakes can be operated to apply a controlled gripping or friction force to the tow loop to limit the velocity of the capture frame CF as it "closes" on the sub-ordinate vessel SOV. Thereafter, the interengaged capture frame CF and its sub-ordinate vessel SOV can be winched toward and to the launch/recovery structure LRS.

As mentioned above in relationship to FIG. 10*a* and as a variant of the organization discussed above, the capture frame CF can be held a selected distance aft of the launch/recovery structure LRS by a tether T-1 connected to an auxiliary winch $W_{aux}$.

In the configurations described above, the tension in the extended tow loop TL when the host vessel HV is underway will cause restoring forces that tend to align the capture frame CF with the sub-ordinate vessel SOV. In the case of the embodiment of FIGS. 1-13, the fluid drag forces on the capture frame CF also tends to rotate the capture frame CF about it axis tending to align the capture frame CF with the alignment of tow line; if desired, the capture frame CF can be provided with fixed or controllably movable "dive planes" and/or buoyancy device(s) to further control the alignment and depth-maintenance of the capture frame CF relative the sub-ordinate vessel SOV as a function of the host vessel speed and the size of the tow loop.

As the host vessel HV proceeds on its course and as the winch or winches W (or functional equivalents) are operated to shorten or "take-up" the tendon that defines the tow loop TL, the static and dynamic characteristics of the sub-ordinate vessel SOV and the capture frame CF contribute to create the full constraints that cause the final alignment such that the distance between the sub-ordinate vessel SOV and its capture CF 'close' to allow the sub-ordinate vessel SOV and its capture frame CF to engage with one another as described.

The engagement sequence and the variants described above constitutes the recovery process of the sub-ordinate vessel SOV by which the sub-ordinate vessel SOV and its capture frame CF are "brought aboard" the host vessel while the host vessel is underway at a selected speed or speeds. A launch sequence, by which the sub-ordinate vessel SOV is launched from the host vessel is the substantial opposite of that described above. More specifically, the winch or winches are operated to "play out" the tow loop TL to thereby progressively increase the size of the tow loop TL to allow the capture frame CF (and its sub-ordinate vessel SOV) to move along the rails $R_{port}$ and $R_{starboard}$ of the launch/recovery structure LRS until such time that the capture frame CF (and its sub-ordinate vessel SOV) are in the water. As described above, the forward speed of the host vessel HV assures that the capture frame CF (and its sub-ordinate vessel SOV) will be in trailing alignment along the course of the host vessel HV. With continued elongation of the tow loop TL, those devices attaching the capture frame CF and the sub-ordinate vessel SOV together are released to allow the sub-ordinate vessel SOV to disengage from the capture CF while remaining under tow attached to the tow loop. Thereafter the attachment device AD is released to disconnect the sub-ordinate vessel SOV from the tow line.

In certain circumstances, such as where the host vessel is in a channel, canal, or in a harbor or inlet, or where the host vessel is limited to zero speed, the recovery process discussed above may not be practicable. In those circumstances where the sub-ordinate vessel SOV is equipped with a propulsion system that allows reverse thrust, the sub-ordinate vessel SOV attaches to or is attached to the extended tow loop TL with the sub-ordinate vessel SOV operated in a reverse thrust mode to cause the sub-ordinate vessel SOV to "straighten-out" and tension the tow loop TL and the sub-ordinate vessel SOV maneuvered to line-up itself and the capture frame CF with the launch/recovery structure LRS on or attached to the host vessel. At that point and while the sub-ordinate vessel SOV maintains reverse thrust, the tow loop TL can be shortened to bring the sub-ordinate vessel SOV into engagement with its capture frame CF while the capture frame CF is concurrently or sequentially brought into engagement with the launch/recovery structure LRS.

Figure 17:
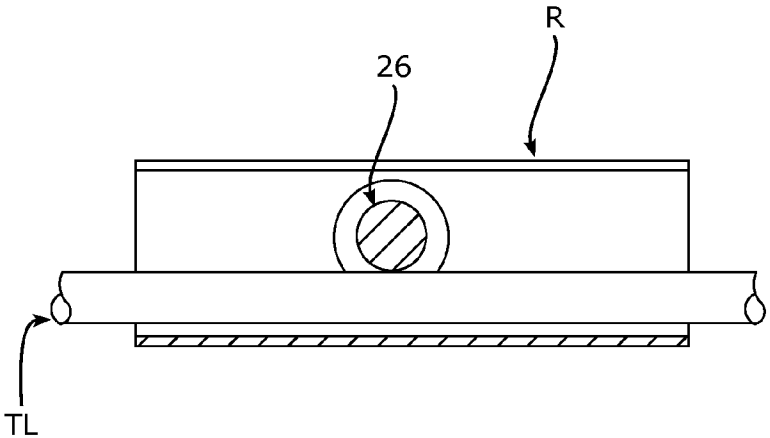
FIG. 17 is a side elevational view of the structure of FIG. 16.
Figure 16:
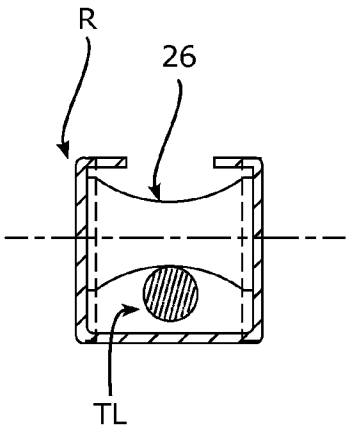
FIG. 16 is an end pictorial view of a movable element within a rail structure.
Figure 19:
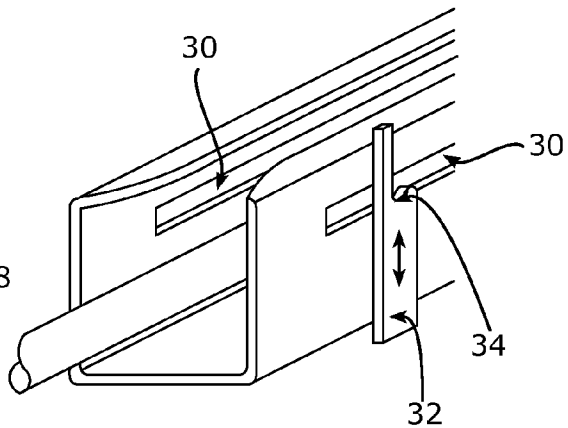
FIG. 19 is a variant of the structure of FIGS. 4, 5 and 6.

FIGS. 16-20 illustrates structural variants associated with the embodiments of FIGS. 1-15. FIGS. 16 and 17 illustrate an alternate moveable element ME in the form of a diploconical roller 26 that fits within the channel defined by the rail member and under which the tow line passes. As shown in dotted-line illustration, an end stop to prevent the roller 26 from exiting the aft end of its rail can be formed form a plate or plates at or near the end of the rail. The releaseable retention device RRD can take of form shown in FIG. 4 but with the friction element pressing laterally against the side of the roller 26.

Figure 20:
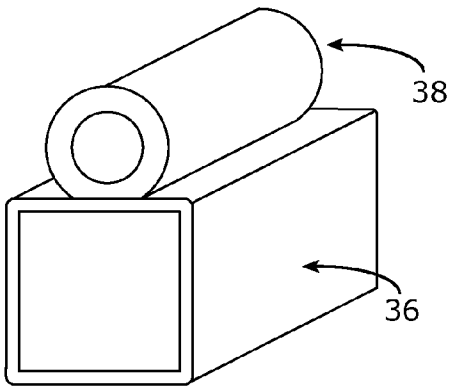
FIG. 20 is a further moveable element variant.
Figure 18:
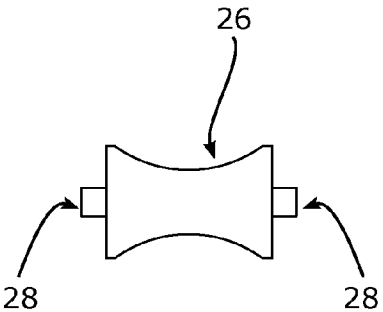
FIG. 18 is a side elevational view of the variant of the movable element of FIG. 16.

A variant of the roller 26 shown in FIGS. 16 and 17 is shown in FIG. 18; as shown, axle extensions 28 can be provided to fit into slots 30 formed in the sides of the rail R as shown in FIG. 20. A reciprocatable plate 32 having a notch 34 functions as the releaseable retention device RRD when the axle extension 28 is received therein.

In the embodiments above, the moveable elements ME have been internal to their rails R; as can be appreciated and as shown in FIG. 20 an external sleeve 36 can be mounted to each rail with the tow line TL carried externally of the rail by a appropriately size tubular member 38.

Figure 21:
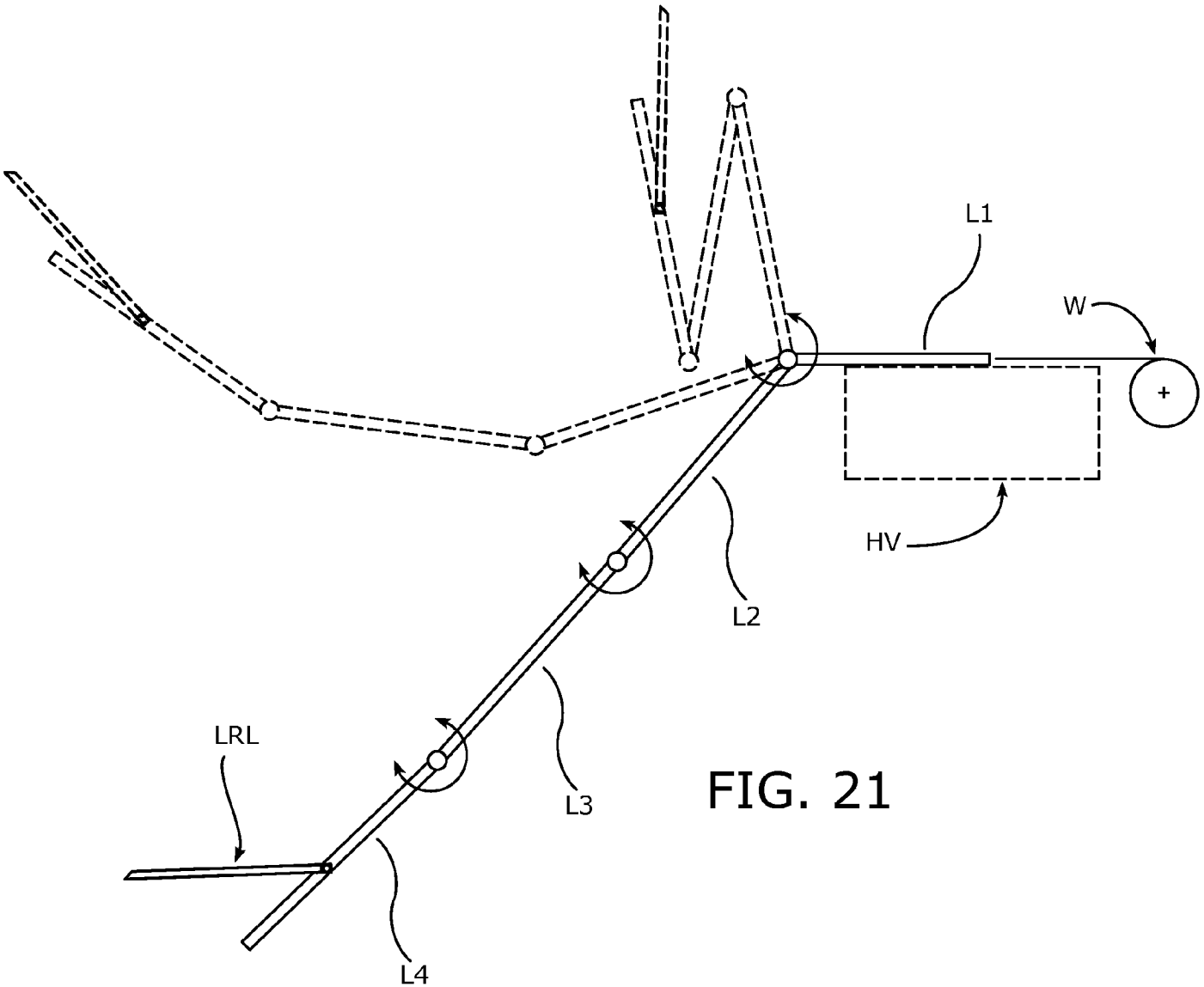
FIG. 21 is a side schematic view of a multi-link launch/recovery structure in a fully deployed or extended position.

The examples discussed above in relationship to FIGS. 1-15 can be considered the general case consistent with the general concept of the present invention; a first preferred embodiment is shown in FIG. 21 and is organized as a multi-link extendible boom with the launch/recovery structure or components associated with the final or last link. As shown, the extendible boom includes a link L1 secured to the host vessel HV (shown in symbolic form as a simple dotted-line rectangle), links L2, L3, and L4 that are pivotally mounted or journalled relative to one another, and a launch/recovery link LRL that is pivotally attached or journalled to the link L4 at a point intermediate the ends thereof. The pivotal interconnection between the various links can include motor/gear train arrangements so the angular relationship between the various links can be controlled/adjusted from the host vessel, but preferably 'free' to self align in equilibrium with external forces. The motor/gear train arrangements can include controllable clutches to allow a "free wheeling" connection or a friction-limited or a friction-controlled braking connection between the links as well as a connection that is under the control of the motor. As an alternative to motor/gear train arrangements, hydraulic or pneumatic control of the pivotal interconnections between the various links is equally suitable. As shown in dotted-line illustration in FIG. 21, the various links can be maintained in a nested or stowed configuration or in one of several partially or fully extended configurations.

Figure 22A:
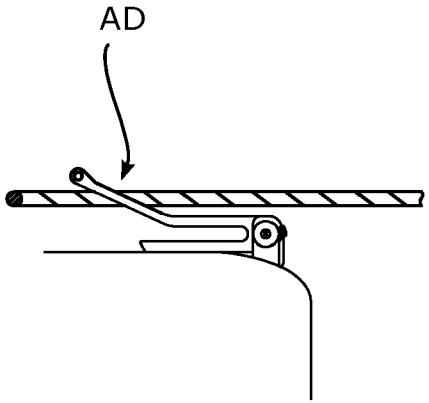
FIG. 22*a* is a detail of an attachment device shown in FIG. 22.
Figure 22:
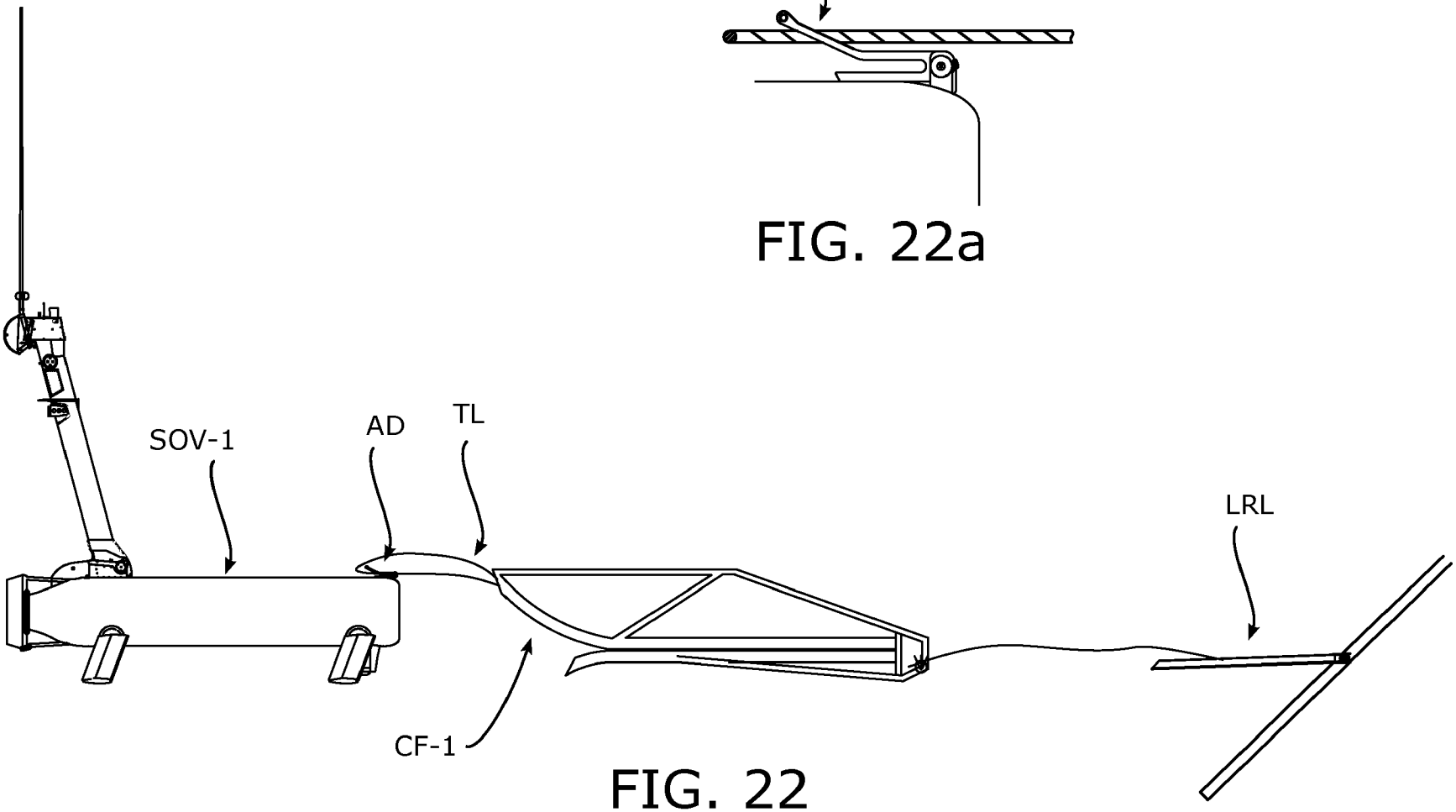
FIG. 22 is a side view of a sub-ordinate vessel, its capture frame, and a launch/recovery structure.
Figure 23:
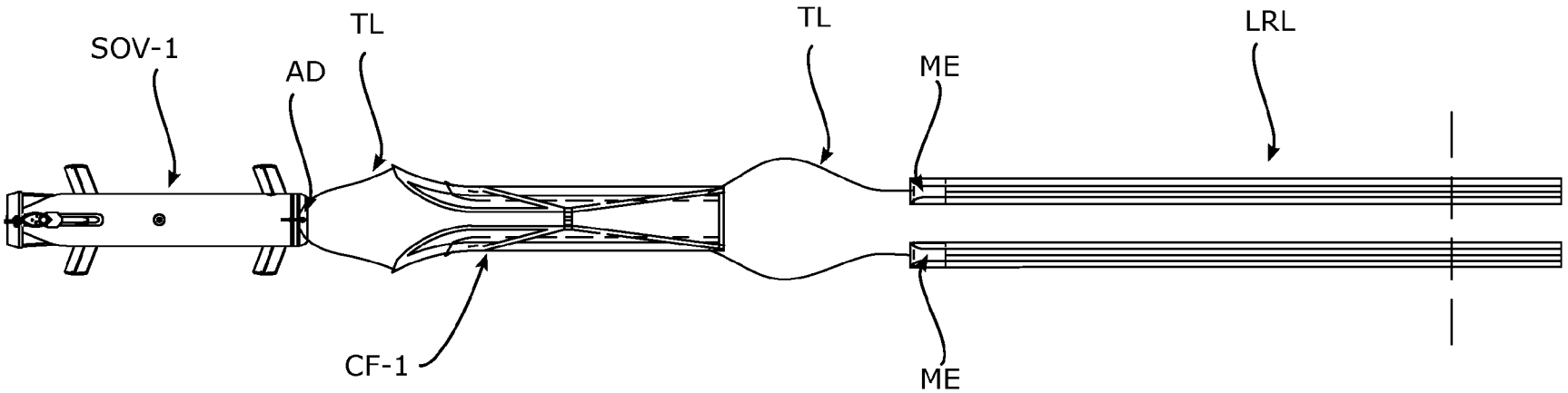
FIG. 23 is a top or plan view of a sub-ordinate vessel, its capture frame, and a launch/recovery structure.

FIGS. 22 and 23 illustrates the terminal portion of the boom assembly shown in FIG. 21 with a representative sub-ordinate vessel SOV-1 shown adjacent the capture frame CF-1 and a portion of the tow loop TL extending between the aft end of the capture frame CF-1 and the attachment device AD (shown in detailed in FIG. 22*a*) on the sub-ordinate vessel SOV-1 and another portion of the tow loop extending between the forward end of the capture frame CF-1 and a point intermediate the ends of the launch/recovery link LRL. As in the case of the embodiments of FIGS. 1-15, the launch/recovery link LRL can take the form of spaced rails that can be interconnected by appropriate structure. Additionally, the capture frame CF-1 is shown as an open frame exoskeleton designed to receive the entire sub-ordinate vessel SOV-1. The capture frame CF-1 can include pads, channels, rails, and appropriately shaped and formed surfaces to receive and "cradle" the sub-ordinate vessel SOV-1 in its mated relationship; as can be appreciated, the exact size, shape, and detailed configuration of the capture frame CF-1 depends on the configuration of the sub-ordinate vessel SOV-1. The capture frame CF-1 can also include various actuatable latches, clamps, and other devices to hold the sub-ordinate vessel SOV-1 in place once mating is achieved.

The extendible boom system of FIG. 22 operates in a recovery mode by first extending the various links as shown in FIG. 22 with the tow loop "paid-out" as desired and the capture frame CF-1 similarly deployed. As shown in the detail of FIG. 22*a*, the tow loop TL can float above the sub-ordinate vessel SOV-1 with the sub-ordinate vessel SOV-1 increasing buoyancy so that the attachment device AD enters the area circumscribed by the tow loop. Thereafter and as the host vessel establishes or continues to maintain a sufficient forward speed, the tow loop will 'catch' the hook-like attachment device AD of the stopped or slowing SOV. In time, the relative speed of the host vessel will take-up the 'slack' of the tow loop TL with the sub-ordinate vessel SOV-1 realigning so that its longitudinal axis is substantially aligned with that of the capture frame CF-1 and the capture frame CF-1 likewise realigning so that its longitudinal axis is substantially aligned with that host vessel HV, as shown in FIG. 23. When this trailing alignment is attained or substantially attained, the appropriate winches can be operated to draw the sub-ordinate vessel SOV-1 toward the capture frame CF-1 until such time that the sub-ordinate vessel SOV-1 mates with its capture frame CF-1. As can be appreciated, the system is maximally compliant when the sub-ordinate vessel SOV-1 is maximally extended with the system becoming progressively less compliant as the sub-ordinate vessel SOV-1 is pulled into its capture frame CF-1. Once the sub-ordinate vessel SOV-1 is mated with its capture frame CF-1, the now mated sub-ordinate vessel SOV-1 and capture frame CF-1 can be drawn onto the launch/recovery link LRL and the various links that define the extensible boom can be withdrawn into the host vessel HV to bring the sub-ordinate vessel SOV-1 aboard.

Figure 24:
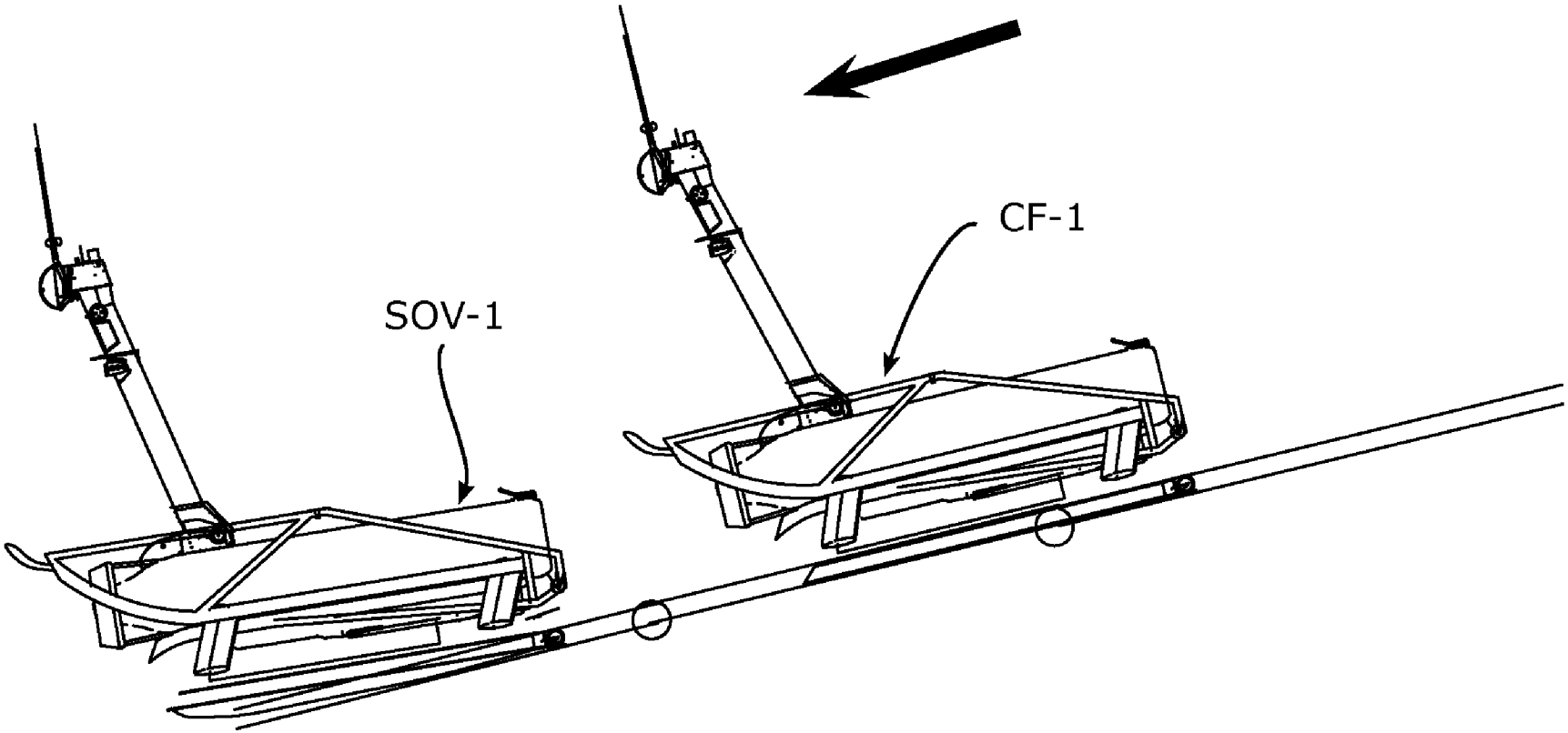
FIG. 24 is a side elevational view of a sub-ordinate vessel and its capture frame on an extendible rotatable link of the launch/recovery structure showing the extendable link in a state of near alignment with or to the launch/recovery structure.
Figure 25:
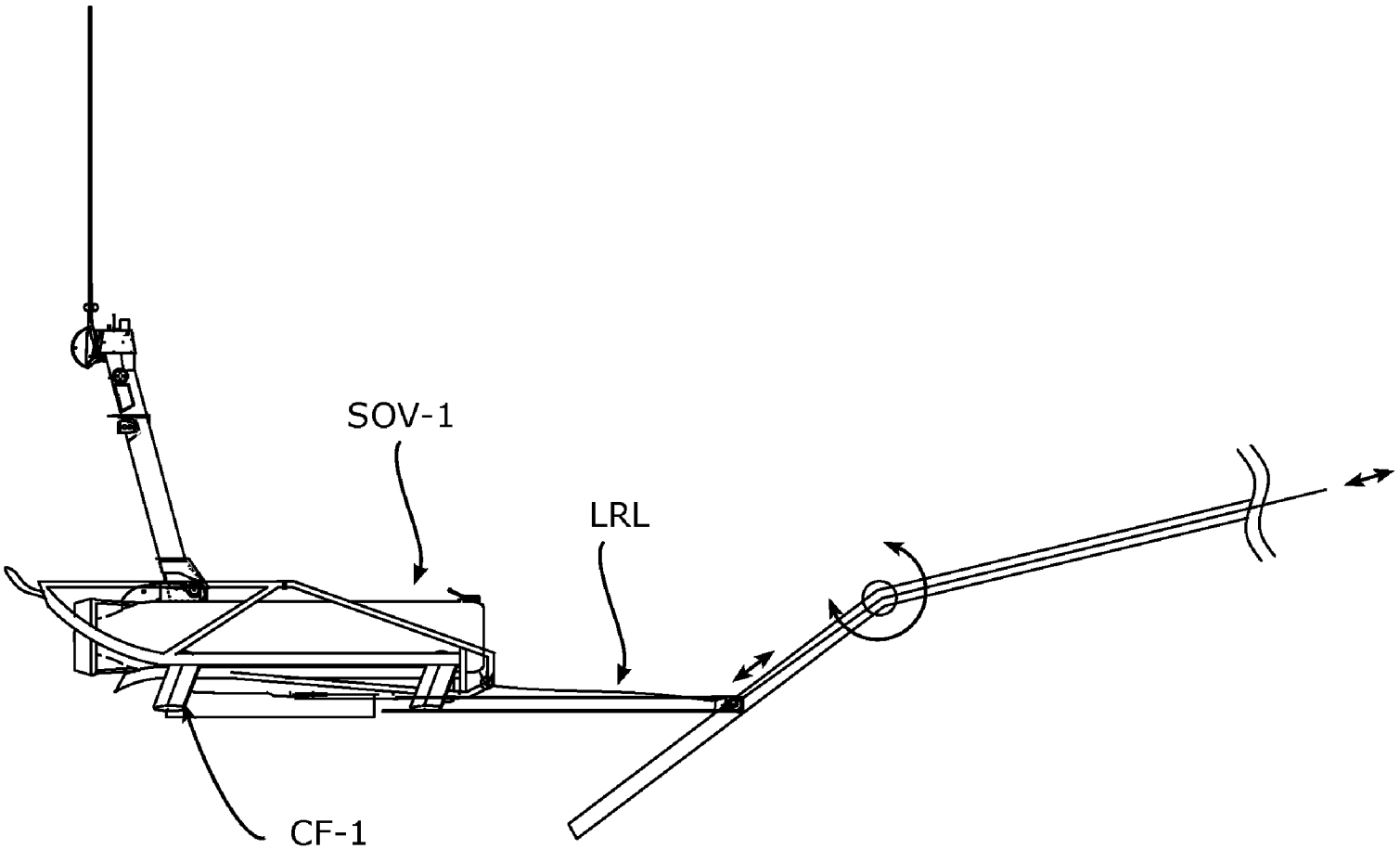
FIG. 25 is a side view of a sub-ordinate vessel and its capture frame on an extendible rotatable link of the launch/recovery structure showing the extendable link in a state of limited freedom with or from the launch/recovery structure.
Figure 26:
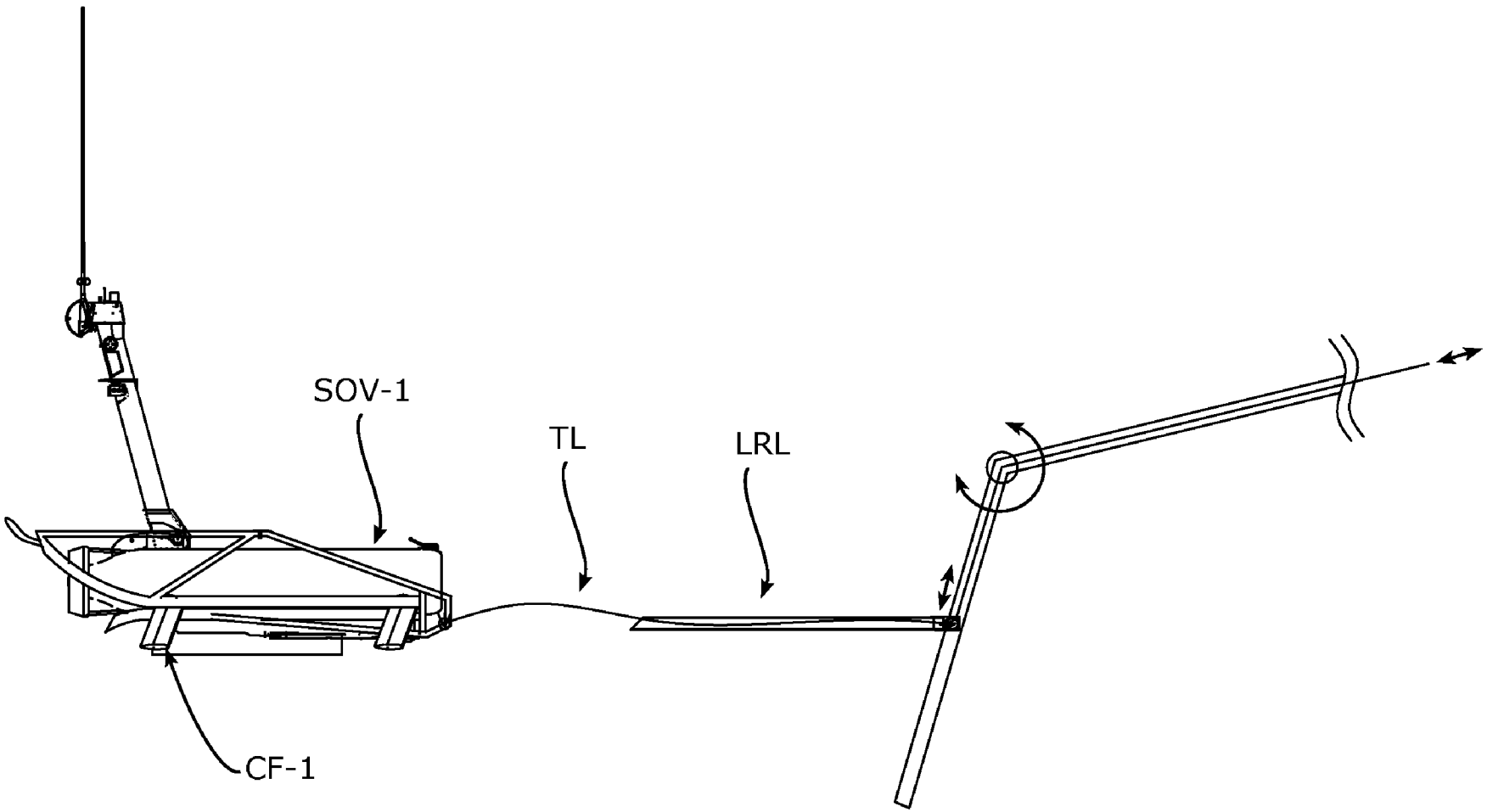
FIG. 26 shows the sub-ordinate vessel of FIG. 25 and its capture frame disengaged from the extendible rotatable link of the launch/recovery structure with the extendable link in a state of greater freedom than that shown in FIG. 25.

In the description above of the system of FIGS. 22-23, the sub-ordinate vessel SOV-1 is described as being 'recovered' by the described structures. As can be appreciated, the system is also suitable for launching a sub-ordinate vessel SOV-1 from the host vessel. For example and as shown in FIGS. 24-26, a sub-ordinate vessel SOV-1 in its exoskeleton-like capture frame CF-1 can be transported in the direction of the arrow (FIG. 24) from the host vessel along the extended multi-link boom into the sea. The combined sub-ordinate vessel SOV-1/exoskeleton can be mounted on rollers (not shown) and transported by a link chain or link belt along the extended boom or ramp. As shown in FIGS. 24-25, the combined sub-ordinate vessel SOV-1/exoskeleton moves along the launch/recovery link LRL with the tow loop slackened in a controlled manner until the combined sub-ordinate vessel SOV-1/capture frame CF-1 disengages from the launch/recovery link LRL into the sea as shown in FIG. 26. Thereafter, the sub-ordinate vessel SOV-1 separates from its exoskeleton-like capture frame CF-1 and then releases or is released from the tow loop. As described above, the process is reversible to effect recovery.

Figure 27:
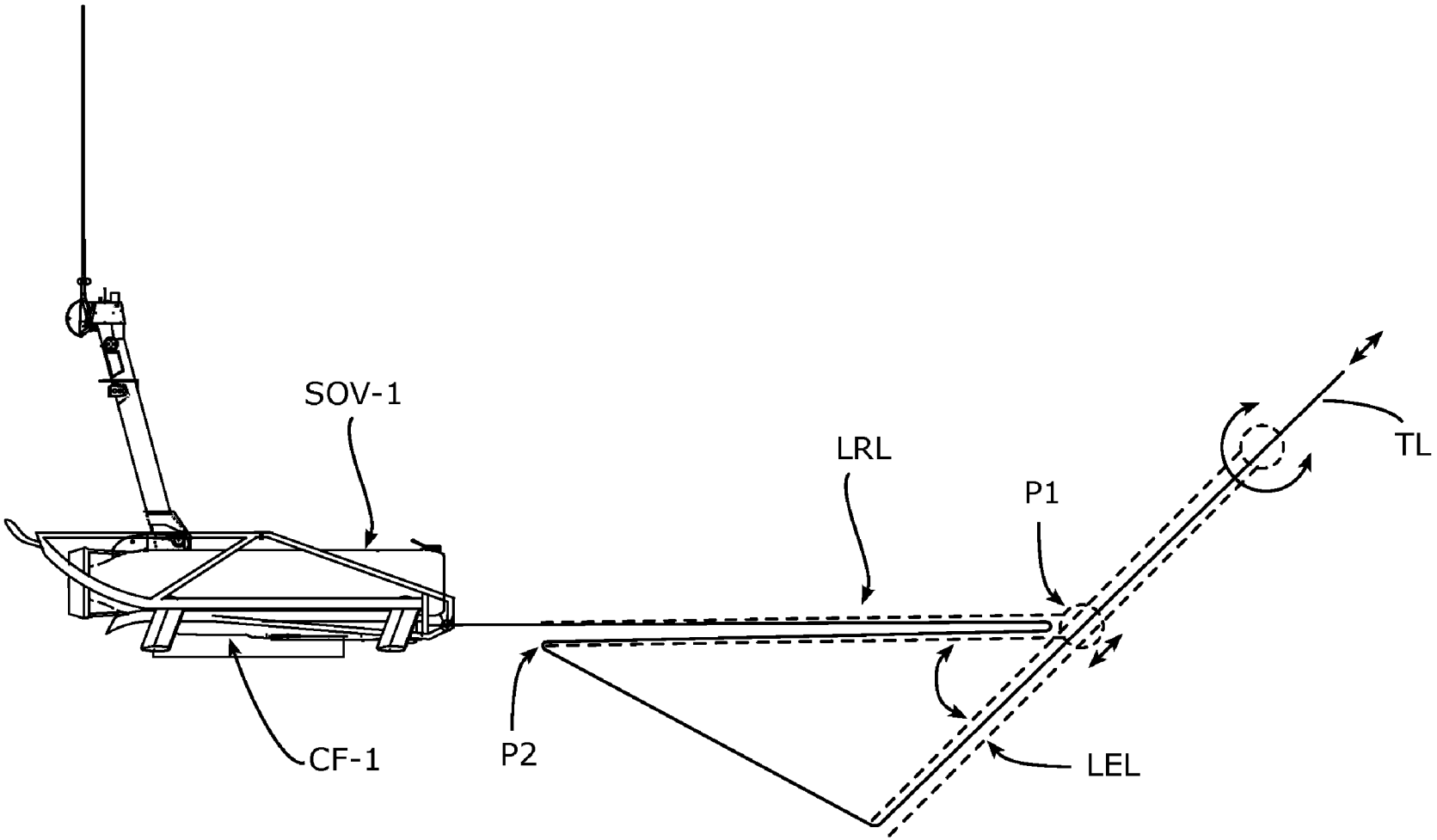
FIG. 27 illustrates a first variant for control of the tow loop.
Figure 28:
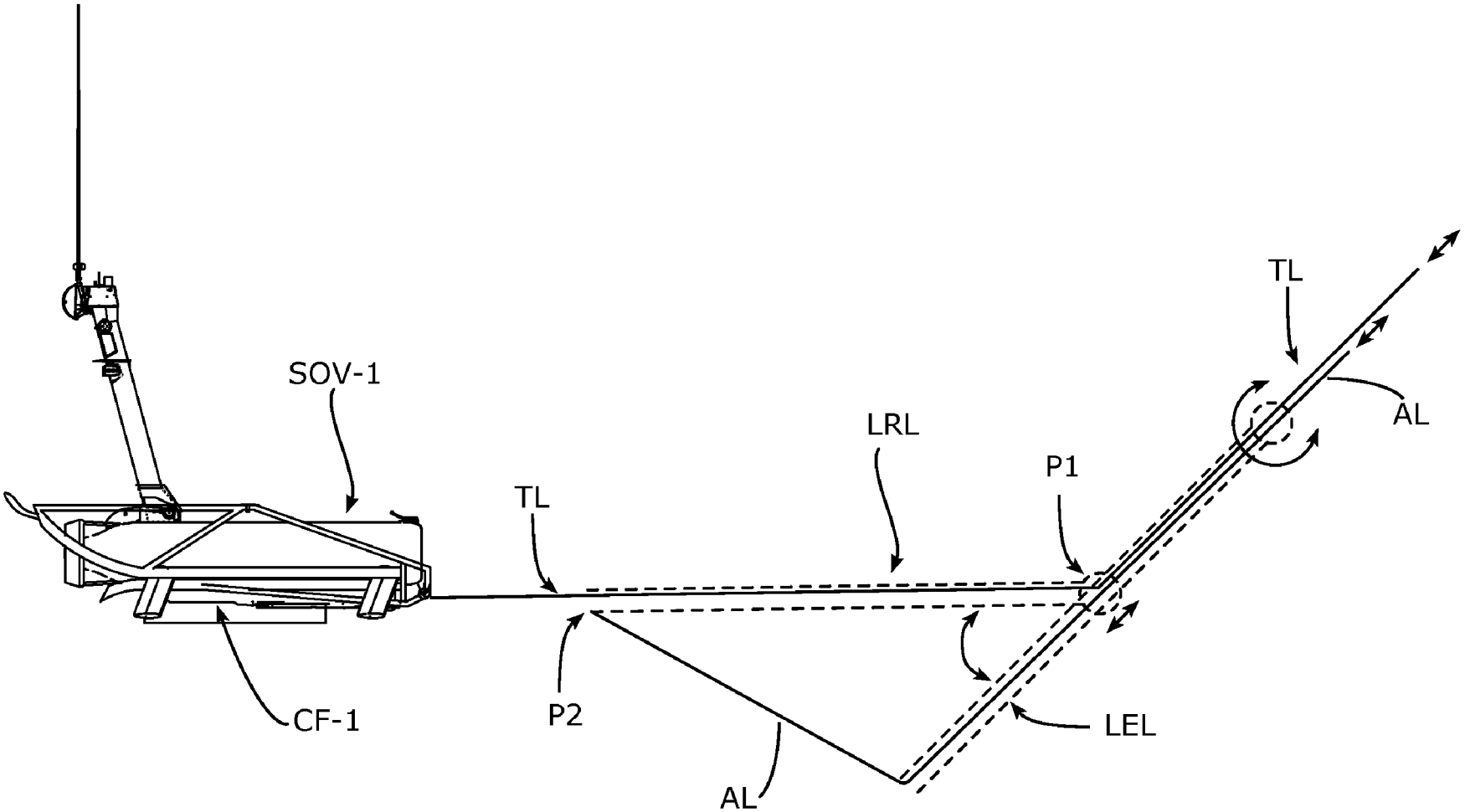
FIG. 28 illustrates a second variant for control of the tow loop and an auxiliary line.
Figure 29:
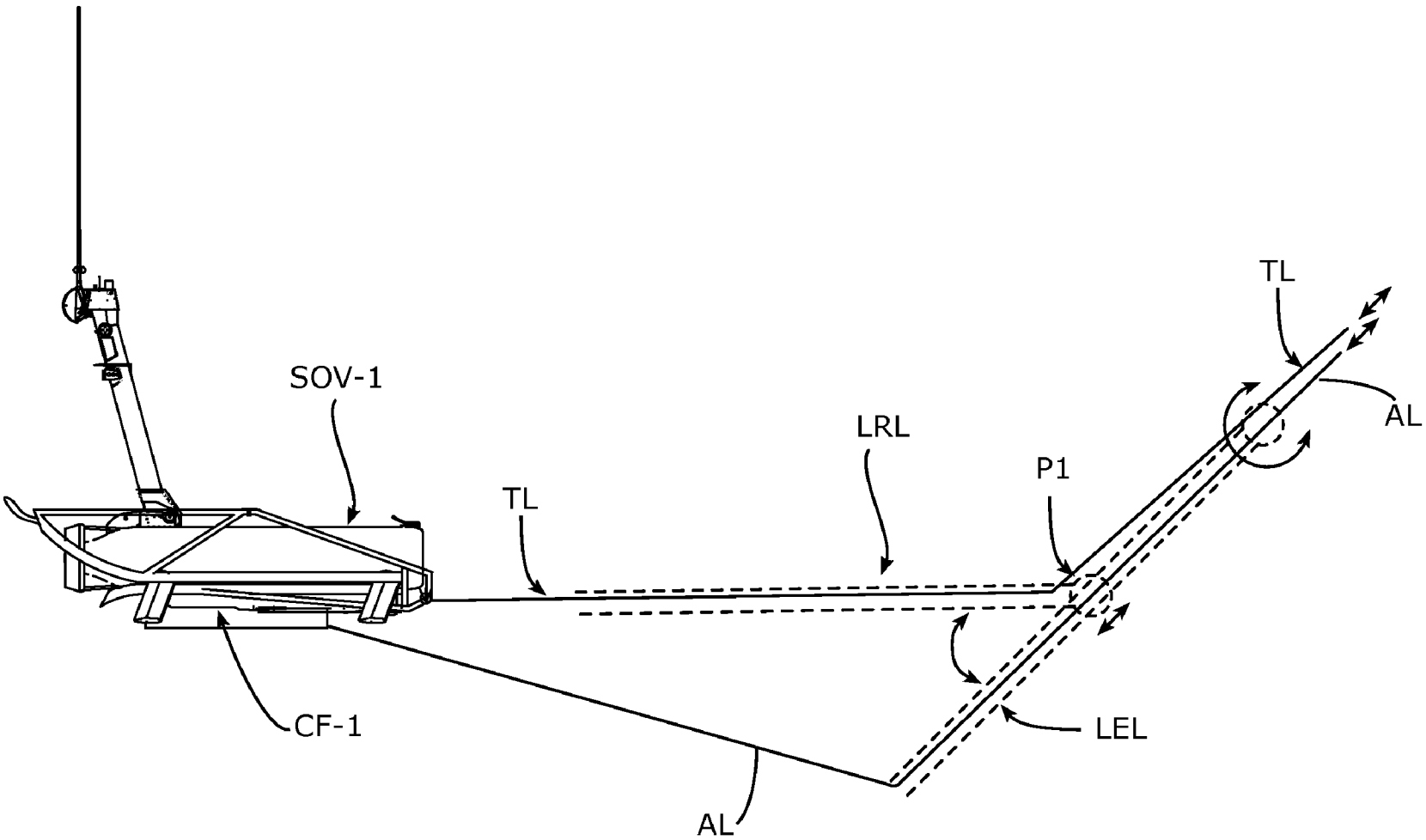
FIG. 29 illustrates a another variant for control of the tow loop and an auxiliary line.

In the embodiments of FIGS. 25 and 26, the tow loop is shown as threaded from the last pivoted link through the launch/recovery link LRL into and through the capture frame CF to the sub-ordinate vessel SOV-1. As shown in FIGS. 27, 28, and 29, other arrangements are possible.

In FIG. 27, the launch/recovery link LRL is pivoted at its proximate end to some point P1 intermediate the ends of the last extensible link LEL. The pivoted relationship at point P1 also allows for bi-directional translation along the last extensible link LEL. As shown, the line that defines the tow loop TL passed through the entire length of and exits the distal end of the last extensible link LEL and enters the distal end of the launch/recovery link LRL at point P2. Thereafter, the tow loop line is "strung" to the proximate end of the launch/recovery link LRL and then reversed to exist the distal end of the launch/recovery link LRL. In the arrangement of FIG. 27, tensioned or taking up the tow loop TL will cause the launch/recovery link LRL and last extensible link LEL to pivot towards one another providing increasing constraints on the system until the capture frame CF and the sub-ordinate vessel SOV-1 to mate; thereafter, the launch/recovery link LRL will translate along the last extensible link LEL toward the proximate end thereof. As can be appreciated, FIG. 27 is diagrammatic and various reeving, pulleys, guides, etc. are not shown.

In FIG. 28, the line that defines the tow loop TL extends along the last extensible link LEL and enters the launch/recovery link LRL at point P1 to exit the distal end of the launch/recovery link LRL. Additionally, a separate auxiliary line AL passes through the last extensible link LEL to exit the distal end of the last extensible link LEL to be secured at or near the distal end of the launch/recovery link LRL. The arrangement of FIG. 28 thus allows the auxiliary line AL to be placed under the control of a winch (not shown) other than the winch(es) W that controls the tow loop TL to provide independent control of both lines to effect increased or decreased constraints during launch and/or recovery.

The embodiment of FIG. 29 is a variant of that of FIG. 28, in which the auxiliary line AL is secured to some part of the capture frame CF rather than the distal end of the launch/recovery link LRL. As in the case of the embodiment of FIG. 28, the separate auxiliary line AL is placed under the control of a winch (not shown) other than the winch(es) W that controls the tow loop TL to provide independent control of both lines to effect increased or decreased constraints during launch and/or recovery.

While the various embodiments described herein have been described as attached to the stern of a host vessel, as can be appreciated other arrangements are possible, for example, the various components can be attached to the host vessel on the port and/or starboard side of the host vessel at non-stern locations, i.e., midships. Additionally, while a rail system has been described as the preferred embodiment, as can be appreciated, the rails can be part or integrated into a ramp structure.

As will be apparent to those skilled in the art, various changes and modifications may be made to the illustrated embodiment of the present invention without departing from the spirit and scope of the invention as determined in the appended claims and their legal equivalent.

The invention claimed is:

1. A system for the launching and recovery of a waterborne sub-ordinate vessel from a marine host vessel, comprising:

a capture structure for detachable attachment to a sub-ordinate vessel;

a launch and recovery structure connected to the host vessel and including at least first and second elongated guideway members each coupled to the host vessel by a pivotable connection having a pivot axis for pivotal motion thereabout, said first guideway member being spaced transversely from said second guideway member, said first guideway member having a moveable element coupled thereto for relative movement therealong and said second guideway member having a moveable element coupled thereto for relative movement therealong;

an extensible tow loop passing from said launch and recovery structure through said capture structure for selective connection or disconnection to a sub-ordinate vessel, a first portion of the tow loop coupled to the moveable element of said first guideway member for relative movement therebetween and a second portion of the tow loop coupled to the moveable element of said second guideway member for relative movement therebetween;

means for controlled lengthening and shortening of said tow loop to cause said capture structure to move along the first and second guideway members to launch the capture structure into the water and for recovery of the capture structure from the water; and means for connecting a sub-ordinate vessel to the tow loop;

wherein lengthening said tow loop when a capture structure having sub-ordinate vessel attached thereto is on said launch and recovery structure causes at least said capture structure and the sub-ordinate vessel attached thereto to move along the first and second guideway members to launch the capture structure and the sub-ordinate vessel attached thereto into the water and shortening of said tow loop when a sub-ordinate vessel is attached to the capture structure causes said attached capture structure and sub-ordinate vessel to engage the first and second guideway members for relative movement therealong for recovery of the capture structure and attached sub-ordinate vessel from the water.

2. The system of claim 1, further comprising:

means for holding the capture frame at a selected position on the tow line relative to the launch and recovery structure.

3. The system of claim 2, wherein said means for holding comprises brake elements for holding the tow line at a selected position.

4. The system of claim 1, further comprising:

means for holding the capture frame at a selected position relative to the launch and recovery structure.

5. The system of claim 4, wherein said means for holding comprises a tether line for holding the capture frame at a selected position relative to the launch and recovery structure.

6. The system of claim 5, further comprising:

means for controlling the length of the tether line to hold the capture frame at a selected position relative to the launch and recovery structure.

7. The system of claim 1, wherein said first and second guideway members are independently pivotable relative to each other.

8. The system of claim 1, further comprising:

means connected to a portion of the tow loop for selectively engaging the capture frame to hold the capture frame a selected distance from the launch and recovery structure.

9. The system of claim 8, wherein said means for holding comprises a cable stop.

10. The system of claim 1, further comprising:

means for selectively preventing relative movement between each moveable element and its respective guideway member.

11. The system of claim 10, wherein said means for preventing relative movement is located at the distal end of each guideway member.

12. The system of claim 10, wherein said means for preventing relative movement is located intermediate the distal end of each guideway member and said pivotable connection.

13. The system of claim 1, wherein said pivotable connection comprises at least one elongated link pivotally connected at one end to said launch and recovery structure and pivotally connected at the other end thereof to said host vessel.

14. The system of claim 1, wherein said pivotable connection comprises at least first and seconded elongated links pivotally connected interconnected at respective first ends thereof, the second end of a first link pivotally connected to said launch and recovery structure and the second end of said second link pivotally connected to said host vessel.

15. The system of claim 1, wherein said pivotable connection comprises at least first and seconded elongated links pivotally connected interconnected at respective first ends thereof, an intermediate portion of the first link pivotally connected to said launch and recovery structure and the second end of said second link pivotally connected to said host vessel.

16. A system for the recovery of a water-borne sub-ordinate vessel from a marine host vessel, comprising:

a capture structure for detachable attachment to a sub-ordinate vessel;

a recovery structure connected to the host vessel and including at least first and second elongated guideway members each coupled to the host vessel by a pivotable connection having a pivot axis for pivotal motion thereabout, said first guideway member being spaced transversely from said second guideway member, said first guideway member having a moveable element coupled thereto for relative movement therealong and said second guideway member having a moveable element coupled thereto for relative movement therealong;

an extensible tow loop passing from at least said recovery structure through said capture structure for selective connection to the sub-ordinate vessel, a first portion of the tow loop coupled to the moveable element of said first guideway member for relative movement therebetween and a second portion of the tow loop coupled to the moveable element of said second guideway member for relative movement therebetween;

means for the controlled lengthening and shortening of said tow loop to cause said capture structure to move along the first and second guideway members to recover the capture structure from the water; and means for connecting the sub-ordinate vessel to the tow loop;

wherein shortening of said tow loop when the sub-ordinate vessel is connected to said tow loop causes at least said capture structure and the sub-ordinate vessel to attach and further shortening of said tow loop causes said attached capture structure and sub-ordinate vessel to engage said recovery structure for recovery of the capture structure and attached sub-ordinate vessel from the water.

17. The system of claim 16, further comprising:

means for holding the capture structure at a selected position on the tow line relative to the recovery structure.

18. The system of claim 17, wherein said means for holding comprises brake elements for holding the tow line at a selected position.

19. The system of claim 16, further comprising:

means for holding the capture structure at a selected position relative to the recovery structure.

20. The system of claim 19, wherein said means for holding comprises a tether line for holding the capture structure at a selected position relative to the recovery structure.

21. The system of claim 20, further comprising:

means for controlling the length of the tether line to hold the capture structure at a selected position relative to the recovery structure.

22. A method for recovering a water-borne sub-ordinate vessel by a marine host vessel, the host vessel having a recovery system including a capture frame for detachable attachment to the sub-ordinate vessel, a recovery structure including at least first and second elongated guideway members each coupled to the host vessel by a pivotable connection having a pivot axis for pivotal motion thereabout, said first guideway member being spaced transversely from said second guideway member, said first guideway member having a moveable element coupled thereto for relative movement therealong and said second guideway member having a moveable element coupled thereto for relative movement therealong, and an extensible tow loop having a first portion thereof coupled to the moveable element of said first guideway member for relative movement therebetween and a second portion thereof coupled to the moveable element of said second guideway member for relative movement therebetween, said extensible tow loop passing from said launch structure via the capture frame for selective connection with the sub-ordinate vessel to be recovered and a controllable device for the controlled lengthening and shortening of the tow loop, comprising the steps of:

causing the host vessel to move at a selected speed in a selected direction;

lengthening the tow loop to cause the capture frame to move along the first and second guideway members to launch the capture frame from the launch structure so as to position the capture frame aft of the host vessel;

maintaining the position of the capture frame at a selected distance aft of the host vessel;

connecting the sub-ordinate vessel to the tow loop;

shortening the tow loop to cause the connected sub-ordinate vessel to attach to the capture frame; and further shortening the tow loop to cause the capture frame and the attached sub-ordinate vessel to engage the first and second guideway members and move therealong for recovery.

23. The method of claim 22, wherein said maintaining step further comprises holding the position of the capture frame on the tow line to maintain the position of the capture frame at a selected distance aft of the host vessel.

24. The method of claim 23, wherein said maintaining step further comprises tethering the position of the capture frame to the host vessel to maintain the position of the capture frame at a selected distance aft of the host vessel.

25. A system for launching a water-borne sub-ordinate vessel from a marine host vessel, comprising:

a capture structure for having a sub-ordinate vessel detachably attached thereto;

a launch structure connected to the host vessel and including at least first and second elongated guideway members each coupled to the host vessel by a pivotable connection having a pivot axis for pivotal motion thereabout, said first guideway member being spaced transversely from said second guideway member, said first guideway member having a moveable element coupled thereto for relative movement therealong and said second guideway member having a moveable element coupled thereto for relative movement therealong;

an extensible tow loop passing from at least said launch structure through said capture structure for selective connection to the sub-ordinate vessel, a first portion of the tow loop coupled to the moveable element of said first guideway member for relative movement therebetween and a second portion of the tow loop coupled to the moveable element of said second guideway member for relative movement therebetween;

means for controlled lengthening of said tow loop to cause said capture structure and the sub-ordinate vessel attached thereto move along the guideway to launch the capture structure and the sub-ordinate vessel attached thereto into the water;

means for selectively disconnecting the sub-ordinate vessel from the capture frame; and means for selectively disconnecting the sub-ordinate vessel from the tow loop.

26. The system of claim 25, further comprising:

means for holding the capture frame at a selected position on the tow line relative to the launch structure.

27. The system of claim 26, wherein said means for holding comprises brake elements for holding the tow line at a selected position.

28. The system of claim 25, further comprising:

means for holding the capture frame at a selected position relative to the launch structure.

29. The system of claim 28, wherein said means for holding comprises a tether line for holding the capture frame at a selected position relative to the launch structure.

30. The system of claim 29, further comprising:

means for controlling the length of the tether line to hold the capture frame at a selected position relative to the launch structure.

31. A method for the launching of a water-borne sub-ordinate vessel by a marine host vessel, the host vessel having a launch system including a capture frame for detachable attachment to the sub-ordinate vessel, a launch structure including at least first and second elongated guideway members each coupled to the host vessel by a pivotable connection having a pivot axis for pivotal motion thereabout, said first guideway member being spaced transversely from said second guideway member, said first guideway member having a moveable element coupled thereto for relative movement therealong and said second guideway member having a moveable element coupled thereto for relative movement therealong, and an extensible tow loop having a first portion thereof coupled to the moveable element of said first guideway member for relative movement therebetween and a second portion thereof coupled to the moveable element of said second guideway member for relative movement therebetween, said extensible tow loop passing from said launch structure via the capture frame for selective connection with the sub-ordinate vessel to be recovered and a controllable device for the controlled lengthening and shortening of the tow loop, comprising the steps of:

attaching the sub-ordinate vessel to the capture frame;

causing the host vessel to move at a selected speed in a selected direction;

lengthening the tow loop to cause the capture frame and the attached sub-ordinate vessel to move along the guideway to launch the capture frame and the attached sub-ordinate vessel from the launch structure so as to position the capture frame and the attached sub-ordinate vessel aft of the host vessel;

detaching the sub-ordinate vessel from the capture frame; and disconnecting the sub-ordinate vessel from the tow loop.

32. The method of claim 31, further comprising, prior to said detaching step, the step of holding the position of the capture frame on the tow line to maintain the position of the capture frame at a selected distance aft of the host vessel.

33. The method of claim 32, further comprising, prior to said detaching step, the steps of holding the position of the capture frame on the tow line to maintain the position of the capture frame at a selected distance aft of the host vessel and further lengthening of said tow loop.

34. The method of claim 33, further comprising, prior to said detaching step, the step of tethering the position of the capture frame relative to the launch structure to maintain the position of the capture frame at a selected distance aft of the host vessel.

* * * * *